US007831159B2

(12) United States Patent
Ishida

(10) Patent No.: US 7,831,159 B2
(45) Date of Patent: Nov. 9, 2010

(54) IMAGE FORMING APPARATUS FOR FORMING TONER IMAGE USING DEVELOPER MADE OF TONER AND CARRIER

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 11/874,751

(22) Filed: Oct. 18, 2007

(65) Prior Publication Data

US 2008/0285993 A1 Nov. 20, 2008

(30) Foreign Application Priority Data

Dec. 6, 2006 (JP) ..... 2006-329622

(51) Int. Cl.
*G03G 15/08* (2006.01)
*G03G 15/10* (2006.01)

(52) U.S. Cl. ..... 399/27; 399/58

(58) Field of Classification Search ..... 399/27, 399/30, 32, 49, 53, 58, 60, 61, 128, 149, 399/150, 258, 260
See application file for complete search history.

(56) References Cited

U.S. PATENT DOCUMENTS 5,461,462 A * 10/1995 Nakane et al. ..... 399/60 X
5,581,221 A * 12/1996 Kawai et al. ..... 399/49
6,744,994 B2 * 6/2004 Yoshikawa et al. ..... 399/150 X

FOREIGN PATENT DOCUMENTS

| | | | |
|---|---|---|---|
| JP | 9-281783 | A | 10/1997 |
| JP | 9-305009 | A | 11/1997 |
| JP | 2001-215798 | A | 8/2001 |
| JP | 2001-215799 | A | 8/2001 |
| JP | 2003-316202 | A | 11/2003 |
| JP | 2004-117960 | A | 4/2004 |

* cited by examiner

*Primary Examiner*—Sandra L Brase
(74) *Attorney, Agent, or Firm*—Canon USA Inc IP Div

(57) ABSTRACT

An apparatus is configured to charge an image bearing member in a charging section, develop an electrostatic image formed on the image bearing member, and transfer a toner image formed on the image bearing member to a transfer medium in a transfer section. The apparatus includes a charging auxiliary apparatus for changing a charge amount of toner on the image bearing member. The charging auxiliary apparatus includes a charging auxiliary member contacting with the image bearing member downstream of the transfer section and upstream of the charging section and a voltage applying device to apply a voltage to the charging auxiliary member. The apparatus includes a first detector to detect a current flowing in the charging auxiliary member during a period of non-image formation when the voltage is applied to the charging auxiliary member, a second detector to detect information regarding a toner density in the developing apparatus, and a control device to control toner supply to the developing apparatus based on detection results of both the detectors.

7 Claims, 17 Drawing Sheets

IMAGE FORMING APPARATUS FOR FORMING TONER IMAGE USING DEVELOPER MADE OF TONER AND CARRIER

BACKGROUND OF THE INVENTION

1. Field of the Invention

The present invention relates to an image forming apparatus, such as a copying machine or a laser printer, which utilizes electrostatic recording or electrophotography to develop an electrostatic image formed on an image bearing member by using developer (developing powder) made up of toner and carrier. More specifically, the present invention relates to monitoring and controlling of a toner density (a mixture ratio of toner to carrier) of developer in an image forming apparatus.

2. Description of the Related Art

Generally, in an electrophotographic image forming apparatus, an image is formed on a recording material, such as a sheet of paper, through various image forming processes of charging, exposure, development, transfer, fusing, and cleaning. More specifically, after uniformly charging the surface of an electrophotographic photosensitive member (hereinafter referred to as a "photosensitive member"), an electrostatic image (latent image) is formed by exposure corresponding to image information. The electrostatic image is developed into a toner image by using a toner, and the toner image is transferred from the photosensitive member to a recording material, e.g., a sheet of paper. After the transfer of the toner image, the photosensitive member is cleaned by removing the toner that remains on the surface of the photosensitive member after the transfer. On the other hand, the recording material including the transferred toner image is heated and pressed such that the toner image is fixed to the surface of the recording material. The image formation is thereby completed.

As a developer used in the above-described image forming apparatus, a two-component developer made of primarily a nonmagnetic toner and a magnetic carrier mixed with each other (hereinafter also referred to as a "two-component development method") is widely utilized with a recent trend toward higher image quality and a higher speed of full-color image forming apparatuses. With the development method using the two-component developer, the developer including the toner and the carrier is supplied to the surface of a developer bearing member while the toner and the carrier are mixed with each other by a stirring and mixing member. A magnetic roll having a plurality of S and N poles alternately arranged thereon is fixedly positioned within the developer bearing member such that the developer comes into a spike-like standing state (hereinafter referred to as a "magnetic brush") on the surface of the developer bearing member with the aid of magnetic forces generated by the poles. The toner is then attached to the electrostatic (latent) image by making the magnetic brush of the developer contacted with or positioned closely to the surface of the photosensitive member, and by applying a development bias voltage between the developer bearing member and the photosensitive member. As a result, the toner is attached to the electrostatic latent image and the development into the toner image is completed.

In a reversed development method, the development using the two-component developer is performed as follows. An electrostatic force is generated due to a potential difference (hereinafter referred to as a "development potential") between an image area surface potential (V1 potential) on the photosensitive member and a development bias voltage (Vdc potential) applied to the developer bearing member. When the generated electrostatic force becomes larger than an electrostatic force acting to attach the toner and the carrier together, the toner is separated from the carrier and is attached onto the photosensitive member, thus performing the development. In a white blank area, a potential difference (hereinafter referred to as a "fogging prevention potential or Vback potential") between a non-image area surface potential (Vd potential) on the photosensitive member and the development bias voltage (Vdc potential) is properly set so as to prevent the toner from attaching to the photosensitive member and to suppress toner fogging.

In a developing unit using the two-component developer, because a mixture ratio of the toner to the carrier (hereinafter referred to as a "toner density") in the developing unit can change with consumption of the toner, the toner density needs to be monitored and maintained at an appropriate value. If the toner density is not maintained within an appropriate range, an improper mixture ratio of the toner density may cause an image failure, e.g., an image density variation, fogging, or carrier adhesion. Proper control of the toner density is hence important in order to form an image with high quality and high stability. Examples of a conventional method for controlling supply (replenishment) of the toner include a toner density detection method using a toner density detecting unit of the optical detection type or the inductance detection type, and a patch detection method (image density detection method).

Further, a tandem image forming process has recently been used with an increasing demand for a higher speed of the full-color image forming apparatus. With the tandem image forming process, a photosensitive member, a charging apparatus, an exposure apparatus, and a developing apparatus are provided for each of four colors, e.g., yellow, magenta, cyan and black. Those components are arranged in tandem such that an image is formed per unit including those components. By using the tandem image forming process, images of four colors can be formed at the same time and an image output speed can be increased.

Meanwhile, Japanese Patent Laid-Open No. 2004-117960 proposes a cleaner-less image forming apparatus in which a cleaning apparatus is omitted and a toner remaining on a photosensitive member after a transfer step is removed from the photosensitive member by "cleaning performed concurrently with development" in the developing apparatus so that the removed toner is recovered for reuse.

In the cleaning performed concurrently with the development, the toner remaining on the photosensitive member after the transfer step is recovered to the developing apparatus in the next or further subsequent developing step. More specifically, the photosensitive member including the toner remaining after the transfer step and attaching thereto is continuously charged and exposed to form an electrostatic latent image. In the step of developing the electrostatic latent image, of the toner remaining on the surface of the photosensitive member after the transfer step, the toner existing on an area not to be developed (i.e., an non-image area) is removed by application of the fogging prevention potential (Vback) and is recovered to the developing apparatus.

With the concurrent cleaning, because the toner remaining after the transfer step is recovered to the developing apparatus and is reused for the development of the electrostatic latent image in the next or further subsequent developing step, waste toner can be eliminated and maintenance operation can be simplified. Further, with the cleaner-less feature, the surface of the photosensitive member is not abraded by a cleaner. Accordingly, a surface film thickness of the photosensitive member can be kept constant and the lifetime of the photosensitive member can be prolonged. In addition, the cleaner-less feature is advantageous in reducing the size of the image forming apparatus.

In the cleaner-less image forming apparatus in which the cleaning is performed concurrently with the development, the following problem may occur when using, as the charging apparatus, a contact charging apparatus which is brought into contact with the photosensitive member to charge the surface of the photosensitive member. When the after-transfer remaining toner on the photosensitive member passes a contact nip (charging section) between the photosensitive member and the contact charging apparatus, a part of the after-transfer remaining toner, which has a charged polarity reversed to opposite one to a normal polarity, may attach to the contact charging apparatus. The attachment of such toner contaminates the contact charging apparatus beyond an allowable level and may cause a charging failure.

More specifically, the toner serving as a developer contains, though in a small amount, a toner which originally has a charged polarity reversed to opposite one to a normal polarity. Also, even with a toner having the normally charged polarity, the charged polarity of the toner may be reversed under the effect of a transfer bias or a separating discharge, for example, or the charge amount of the toner may be reduced with charge cancellation.

Therefore, the after-transfer remaining toner contains the toner having the normally charged polarity, the reversed toner having the opposite polarity, and the toner having the reduced charge amount in a mixed state. Of those kinds of toners, the reversed toner and the toner having the reduced charge amount may attach to the contact charging apparatus when they pass the contact nip (charging section) between the photosensitive member and the contact charging apparatus.

In order to remove and recover the toner remaining on the photosensitive member after the transfer step in the developing step, the after-transfer remaining toner carried to a developing section through the charging section is required to have the normally charged polarity and to have such a charge amount that the electrostatic latent image on the photosensitive member can be developed by the developing apparatus. The reversed toner and the toner having the improper charge amount cannot be removed and recovered from the photosensitive member to the developing apparatus, thus causing a failed image.

In order to prevent the toner from attaching to the contact charging apparatus, the following process may be performed. For example, the toner remaining on the photosensitive member after the transfer step, which is carried from the transfer section to the charging section and which contains variously charged toner particles (e.g., toner particles having the normally charged polarity, toner particles having the opposite polarity, and toner particles having reduced charge amounts), may be subjected to a charging operation so that the variously charged toner particles can be changed to toner particles having a normal polarity and uniform charge amounts.

Japanese Patent Laid-Open No. 2001-215798 and No. 2001-215799 disclose techniques to address the above-described problem. A toner charge-amount control unit for charging the after-transfer remaining toner is provided, as a charging auxiliary unit, upstream of a contact charging apparatus and downstream of a transfer unit in the moving direction of a photosensitive member. An after-transfer remaining toner uniformalizing unit (remaining toner uniformalizing unit) for making uniform the toner remaining on the photosensitive member after the transfer step is provided upstream of the toner charge-amount control unit and downstream of the transfer unit. The above-described problem may be overcome by contacting both the toner charge-amount control unit and the remaining toner uniformalizing unit with the surface of the photosensitive member and by applying constant DC voltages to those units.

More specifically, the toner remaining on the photosensitive member after the transfer step is uniformalized by the remaining toner uniformalizing unit, and the uniformalized after-transfer remaining toner on the photosensitive member is charged by the toner charge-amount control unit so as to have the normal polarity. Then, at the same time as charging the surface of the photosensitive member by the contact charging apparatus, the after-transfer remaining toner is charged by the toner charge-amount control unit so as to have the charge amount suitable for removing and recovering the after-transfer remaining toner by the developing apparatus through the cleaning performed concurrently with the development. As a result, the after-transfer remaining toner is recovered by the developing apparatus.

The problems that can occur when using the two-component development method will be described below.

If the carrier deteriorates with the long-term use of the image forming apparatus, the supplied toner may not be sufficiently charged in some cases. This causes the so-called fogging of the reversed toner, i.e., a phenomenon that the toner having the reversed polarity fogs over the photosensitive member. Because the reversed toner is charged so as to have the opposite polarity to that of the normal toner, the reversed toner is hardly transferred by the transfer unit and is recovered by the cleaning unit.

In the case of using the tandem image forming method, therefore, the following problem may arise. If the fogging occurs in one image forming unit on the downstream side in the moving direction of a transfer member, the fogging is transferred in a superimposed relation to a toner image formed by another image forming unit on the upstream side. Thus, a tint variation may be caused in an image finally formed on the transfer member.

In the case of using the cleaner-less method, because the cleaner blade is not provided, the reversed toner may contaminate the charging member and the charging auxiliary member if the fogging of the reversed toner occurs to a large extent. Such contamination may cause, e.g., undesired streaks in the image due to a charging failure.

To address the above-described problem, Japanese Patent Laid-Open No. 2003-316202 proposes a cleaner-less image forming apparatus in which toner contamination of a charging auxiliary brush is reduced by periodically expelling the toner out of the charging auxiliary member.

As one example of a method for detecting the occurrence of a fogging toner, Japanese Patent Laid-Open No. 9-281783 proposes a method of detecting the fogging toner by an optical sensor which is disposed on a photosensitive member.

Further, Japanese Patent Laid-Open No. 9-305009 proposes a technique of detecting an amount of toner attached to a magnetic brush charger from a current amount and correcting a charging condition.

With the apparatus proposed in Japanese Patent Laid-Open No. 2003-316202, however, the resulting effect is not sufficient because the apparatus does not intend to suppress the fogging of the reversed toner, which causes the contamination of the charging auxiliary member.

With the method proposed in Japanese Patent Laid-Open No. 9-281783, unless the toner fogging occurs to a large extent, detection accuracy is poor. It is hence difficult to detect a small amount of the fogging toner. Another disadvantage is that an additional space is required to dispose the optical sensor on the photosensitive member.

Further, the technique proposed in Japanese Patent Laid-Open No. 9-305009 does not discuss suppressing the fogging of the reversed toner, which causes the contamination of the charging auxiliary member. Another disadvantage is that one of two phenomena, i.e., whether the toner fogging occurs or a large amount of the after-transfer remaining toner occurs, cannot be discriminated just by detecting an amount of toner attached to the magnetic brush charger.

SUMMARY OF THE INVENTION

An embodiment of the present invention is directed to an image forming apparatus which can effectively suppress fogging while precisely detecting the occurrence of the fogging on an image bearing member.

According to a first aspect of the present invention, an image forming apparatus includes an image bearing member on which an electrostatic image is capable of being formed, a charging apparatus configured to charge the image bearing member in a charging section, a developing apparatus containing developer which includes toner and carrier, the developing apparatus being configured to develop, in a developing section, an electrostatic image formed on the image bearing member, a transfer apparatus configured to transfer a toner image formed on the image bearing member to a transfer medium in a transfer section, a charging auxiliary apparatus including a charging auxiliary member contacting with the image bearing member at a position downstream of the transfer section and upstream of the charging section in a moving direction of the image bearing member, and a voltage applying device configured to apply a voltage to the charging auxiliary member, the charging auxiliary apparatus being able to change a charge amount of the toner on the image bearing member, a current detecting device configured to detect a current flowing in the charging auxiliary member during a period of non-image formation when the voltage is applied to the charging auxiliary member, a toner density detecting device configured to detect information regarding a toner density of the developer in the developing apparatus, and a toner supply control device configured to control supply of the toner to the developing apparatus based on a detection result of the current detecting device and a detection result of the toner density detecting device.

According to a second aspect of the present invention, an image forming apparatus includes an image bearing member on which an electrostatic image is capable of being formed, a charging apparatus configured to charge the image bearing member in a charging section, a developing apparatus configured to develop, in a developing section, an electrostatic image formed on the image bearing member by applying a voltage to a developer bearing member which bears developer including toner and carrier, a transfer apparatus configured to transfer a toner image formed on the image bearing member to a transfer medium in a transfer section, a charging auxiliary apparatus including a charging auxiliary member contacting with the image bearing member at a position downstream of the transfer section and upstream of the charging section in a moving direction of the image bearing member, and a voltage applying device configured to apply a voltage to the charging auxiliary member, the charging auxiliary apparatus being able to change a charge amount of the toner on the image bearing member, a current detecting device configured to detect a current flowing in the charging auxiliary member during a period of non-image formation when the voltage is applied to the charging auxiliary member, and a controller configured to change a potential difference between a potential of the image bearing member charged by the charging apparatus and a potential of the developer bearing member based on a detection result of the current detecting device.

Further features of the present invention will become apparent from the following description of exemplary embodiments with reference to the attached drawings.

DESCRIPTION OF THE EMBODIMENTS

An image forming apparatus according to the present invention will be described in detail below with reference to the drawings.

First Exemplary Embodiment

Figure 1:
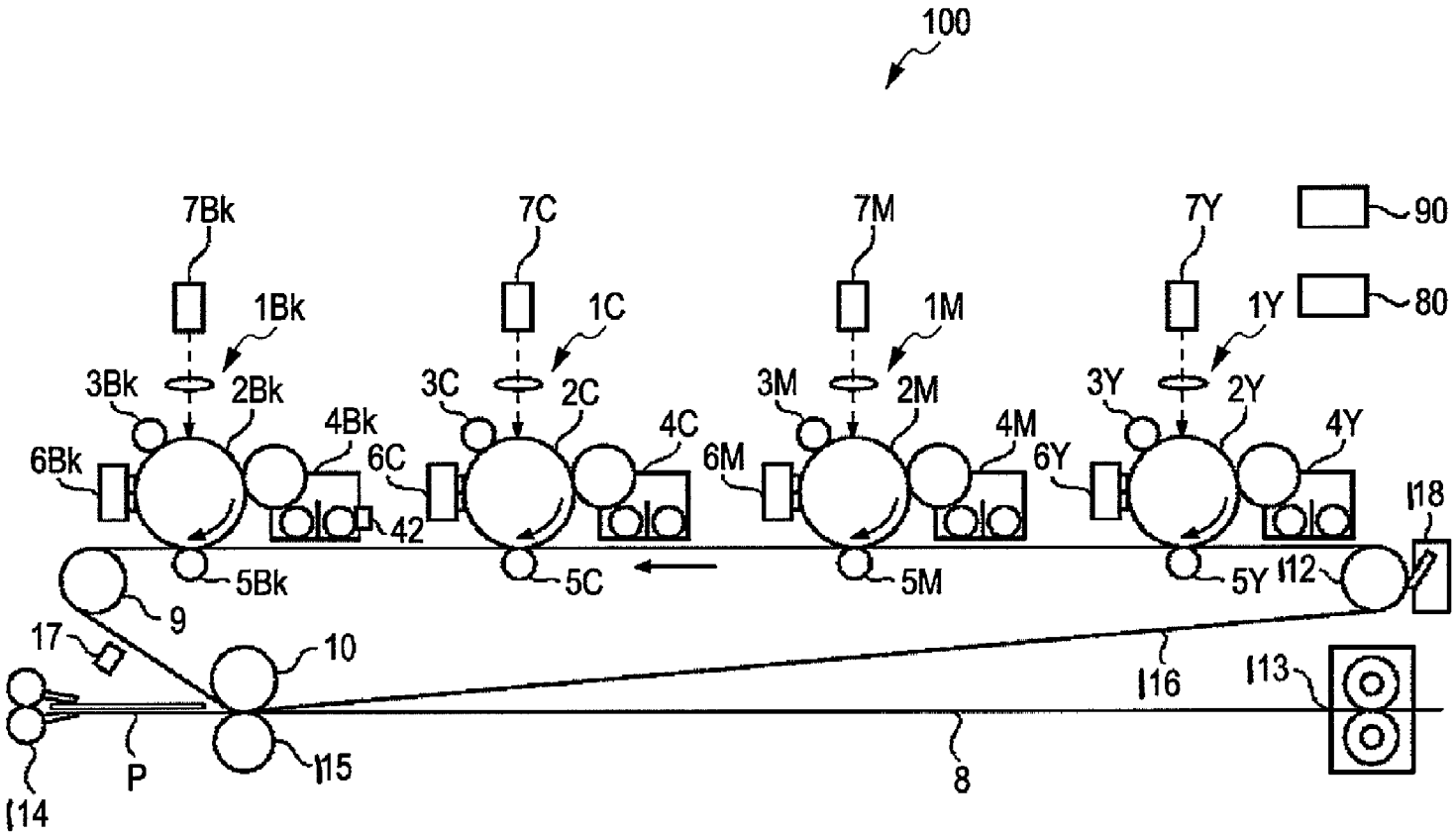
FIG. 1 is a schematic view illustrating one example of an image forming apparatus to which are applied first to third exemplary embodiments of the present invention.

The overall construction and operation of an image forming apparatus according to the first exemplary embodiment are first described. FIG. 1 is a schematic view of an image forming apparatus 100 according to the first exemplary embodiment. The image forming apparatus 100 is an electrophotographic full-color printer including four image forming sections 1Y, 1M, 1C and 1Bk which are provided corresponding to four colors, i.e., yellow, magenta, cyan, and black. The image forming apparatus 100 forms a four-full-color image on a recording material (such as a sheet of recording paper, a plastic film, or cloth) in accordance with an image signal sent from a host apparatus which is connected to a document scanning apparatus or a main unit. Toner images are formed in the four image forming sections 1Y, 1M, 1C and 1Bk on elelectrophotographic photosensitive members 2Y, 2M, 2C and 2Bk which serve as image bearing members, and the toner images are transferred onto an intermediate transfer belt 116. The image having been transferred onto the intermediate transfer belt 116 is further transferred onto a recording material P which is conveyed by a recording-material bearing member 8.

In the first exemplary embodiment, the four image forming sections 1Y, 1M, 1C and 1Bk provided in the image forming apparatus 100 have substantially the same constructions except that development colors differ from each other. Therefore, unless discrimination is specifically required, the following description is made collectively while omitting the affixes Y, M, C and Bk used to represent to which one of the image forming sections the relevant element belongs.

The image forming section 1 includes, as an image bearing member, a cylindrical photosensitive member, i.e., a photosensitive drum 2. The photosensitive drum 2 is driven to rotate in the direction of an arrow indicated in the drawing. In other words, the surface of the image bearing member is moved in the direction of the arrow.

Around the photosensitive drum 2, there are arranged a charging roller 3 as a charging unit, a developing apparatus 4 as a developing unit, a primary transfer roller 5 and a secondary transfer roller 115 each serving as a transfer unit, a secondary transfer opposite roller 10, and a charging auxiliary device 6 as a charging auxiliary unit. A laser scanner (exposure apparatus) 7 as an exposure unit is arranged above the photosensitive drum 2, as viewed on the drawing. Further, the intermediate transfer belt 116 is disposed so as to run in an opposed relation to the photosensitive drum 2 of each image forming section 1. The intermediate transfer belt 116 is driven by a driving roller 9 to circulate in the direction of an arrow indicated in the drawing such that the toner image is conveyed to a contact region where the toner image is contacted with the recording material P. After the toner image is transferred from the intermediate transfer belt 116 to the recording material P, the toner image is fused and fixed to the recording material P by a fusing apparatus 113.

The following description is made of, by way of example, the operating of forming a four-full-color image. When the image forming operation is started, the surface of the rotating photosensitive drum 2 is first uniformly charged in a charging section by the charging roller 3. At that time, a charging bias is applied to the charging roller 3 from a charging-bias power supply. Then, the photosensitive drum 2 is exposed by a laser beam that is emitted from the exposure apparatus 7 in accordance with an image signal. An electrostatic image (latent image) corresponding to the image signal is thereby formed on the photosensitive drum 2. The electrostatic image on the photosensitive drum 2 is visualized to a visible image by a toner contained in the developing apparatus 4. The first exemplary embodiment employs the so-called reversed developing process in which the toner is attached to a potential in a light area exposed by the laser beam.

In a developing section, the toner image is formed on the photosensitive drum 2 by the developing apparatus 4. In a transfer section, the formed toner image is primarily transferred to the intermediate transfer belt 116 which serves as a transfer medium. The toner remaining on the surface of the photosensitive drum 2 after the primary transfer (i.e., the after-transfer remaining toner) can be recovered into the developing apparatus 4 after passing the charging auxiliary device 6.

The above-described operation is successively repeated for each of yellow, magenta, cyan, and black such that the toner images of four colors are superimposed with one another on the intermediate transfer belt 116. Then, in match with the timing of forming the four-color toner image, the recording material P contained in a recording material cassette (not shown) is conveyed by a feed roller 114 and a conveying member 8. By applying a secondary transfer bias to the secondary transfer roller 115, the four-color toner image on the intermediate transfer belt 116 is secondarily transferred onto the recording material P at a time, which is supported on the conveying member 8.

Then, the recording material P is separated from the conveying member 8 and is conveyed to the fusing apparatus 113 which serves as the fusing unit. The recording material P is heated and pressed in the fusing apparatus 113 so that the toners on the recording material P are fused and mixed with one another to produce a full-color permanent image. Thereafter, the recording material P is ejected out of the image forming apparatus.

The toner remaining on the intermediate transfer belt 116 without being transferred in a secondary transfer section is removed by an intermediate transfer belt cleaner 118. A series of image forming operations is thus completed.

A monochromatic image of one desired color or a multicolor image of plural desired colors can also be formed by using only one or more corresponding image forming sections.

The above-described operations of the charging unit, the exposure unit, the developing unit, the transfer unit, the fusing unit, etc. are controlled by a control unit (controller) 80.

The operation in the image forming section 1 will be described in more detail with reference to FIG. 2.

In the first exemplary embodiment, the photosensitive drum 2 is made of an organic photoconductor (OPC) with a negative charging characteristic. The photosensitive drum 2 has an outer diameter of 30 mm and is driven to rotate in the counterclockwise direction, as indicated by the arrow, at a process speed (peripheral speed) of 200 mm/sec about a central support shaft as a center.

A contact charging apparatus (contact charger) 3 is provided as the charging unit for uniformly charging the surface of the photosensitive drum 2. In the first exemplary embodiment, the contact charging apparatus 3 is constituted by a charging roller (roller charger) and charges the drum surface by utilizing a discharge phenomenon that is generated in a small gap between the photosensitive drum 2 and the charging roller 3. A charging bias voltage satisfying a predetermined condition is applied to the charging roller 3 from a power supply S1. The surface of the rotating photosensitive drum 2 is thereby contact-charged to a predetermined polarity and potential. In the first exemplary embodiment, the charging bias voltage applied to the charging roller 3 is an oscillatory voltage obtained by superimposing a DC voltage (Vdc) and an AC voltage (Vac) with reach other. More specifically, the charging bias voltage is an oscillatory voltage obtained by superimposing a DC voltage of −500 V and a sine-wave AC voltage having a frequency of 1.3 kHz and a peak-to-peak voltage Vpp of 1.5 kV. With the application of the charging bias voltage, the surface of the photosensitive drum 2 is uniformly contact-charged to the same DC voltage, i.e., −500 V (dark-area potential Vd), as that applied to the charging roller 3.

In the first exemplary embodiment, the developing apparatus 4 is the type employing the two-component contact development method to perform the development while a magnetic brush formed by a two-component developer (developing powder), which is made up of primarily a toner and a carrier, is contacted with the photosensitive drum 2. The developing apparatus 4 includes a developing container 30 and a nonmagnetic developing sleeve 11 which serves as a developer bearing member.

The developing sleeve 11 is disposed in a closely opposed relation to the photosensitive drum 2 such that the most proximity distance (S-D gap) relative to the photosensitive drum 2 is held at 350 μm. A predetermined developing bias voltage is applied to the developing sleeve 11 from a power supply S2. In the first exemplary embodiment, the developing bias voltage applied to the developing sleeve 11 is an oscillatory voltage obtained by superimposing a DC voltage (Vdc) and an AC voltage (Vac) with reach other. More specifically, the developing bias voltage is an oscillatory voltage obtained by superimposing a DC voltage of −350 V and a rectangular-wave AC voltage having a frequency of 8.0 kHz and a peak-to-peak voltage Vpp of 1.8 kV. The toner in the developer is carried to the developing section in a state of coating, i.e., in the form of a thin layer, over the surface of the rotating developing sleeve 11 and is selectively attached to the surface of the photosensitive drum 2 corresponding to the electrostatic latent image by the action of an electric field produced by the developing bias voltage. Thus, the electrostatic latent image is developed into the toner image.

The developing apparatus 4 and a toner supply apparatus 49 will be described in detail with reference to FIGS. 3 and 4. In the first exemplary embodiment, the developing apparatus 4 and the toner supply apparatus 49 have the same construction for each of yellow, magenta, cyan, and black.

Figure 3:
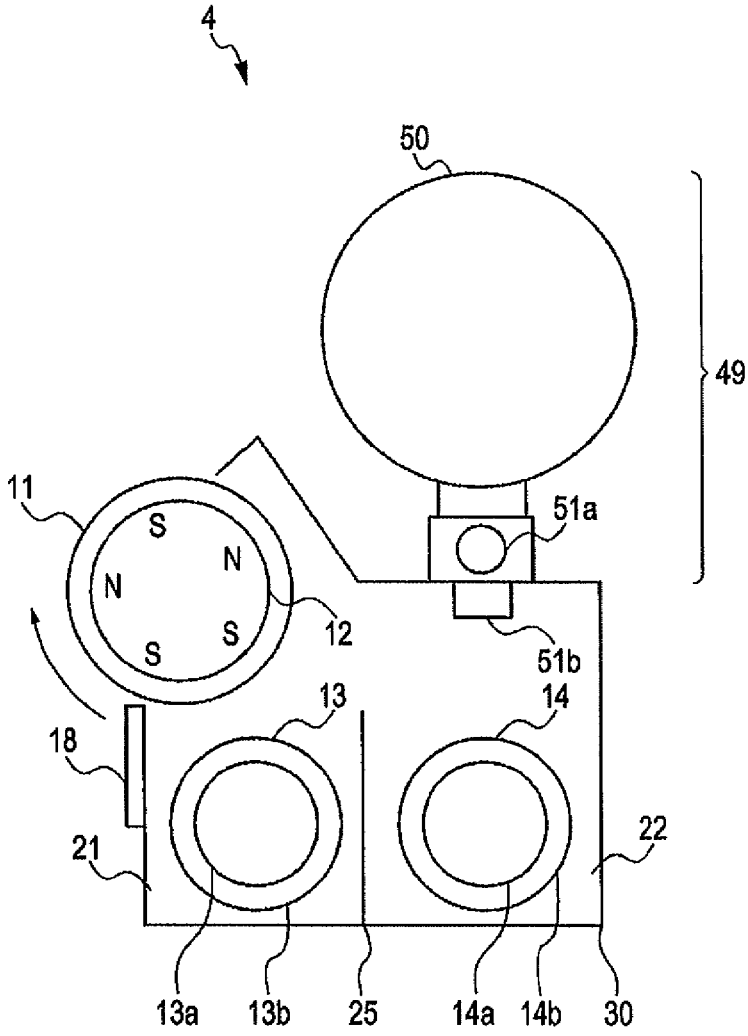
FIG. 3 is an explanatory view illustrating a developing apparatus and a toner supply device to which is applied one exemplary embodiment of the present invention.

As shown in FIG. 3, the developing apparatus 4 includes the developing container 30 storing the developer. In the developing container 30, a two-component developer made up of primarily a nonmagnetic toner (toner) and a magnetic carrier (carrier) is stored as the developer. The toner density of the developer in an initial state is 7% by weight in an exemplary embodiment. Such a value of the toner density is not required to be always satisfied because the toner density should be properly adjusted depending on the charge amount of the toner, the particle diameter of the carrier, the construction of the image forming apparatus, etc.

The developing container 30 is partly opened at a position opposed to the photosensitive drum 2, and the developing sleeve 11 serving as the developer bearing member is rotatably disposed in the developing container 30 such that a part of the developing sleeve 11 is exposed to the outside through the opening of the developing container 30. The developing sleeve 11 is made of a nonmagnetic material and includes a stationary magnet 12 which serves as a magnetic field generating unit. In the first exemplary embodiment, the magnet 12 has a plurality of magnetic poles along its outer periphery. In the developing operation, the developing sleeve 11 is rotated in the direction of an arrow indicated in the drawing such that the two-component developer in the developing container 30 is held thereon in the form of a surface layer and is conveyed to a development region which is positioned in an opposed relation to the photosensitive drum 2. The developer carried on the developing sleeve 11 forms a magnetic brush standing like a spike in the development region. By contacting or positioning the magnetic brush with or close to the surface of the photosensitive drum 2, the toner in the two-component developer is attracted toward the photosensitive drum 2 corresponding to the electrostatic image which is formed on the surface of the photosensitive drum 2. The development of the electrostatic image is thus performed.

Usually, at least during the developing operation, the predetermined developing bias voltage is applied to the developing sleeve 11 so that the toner is drifted toward the photosensitive drum 2 by the action of an electric field formed between the photosensitive drum 2 and the developing sleeve 11. Also, to restrict the amount of the developer carried on the developing sleeve 11, a developer-amount restricting unit 18 is provided to restrict the thickness of a developer layer by the action of a magnetic field in cooperation with the magnet 12 on the side upstream of the developing region in the rotating direction of the developing sleeve 11.

The developer remaining after the development of the electrostatic image on the photosensitive drum 2 is conveyed with the rotation of the developing sleeve 11 and is recovered into a later-described developing chamber (first developer containing chamber) 21 of the developing container 30.

Figure 4:
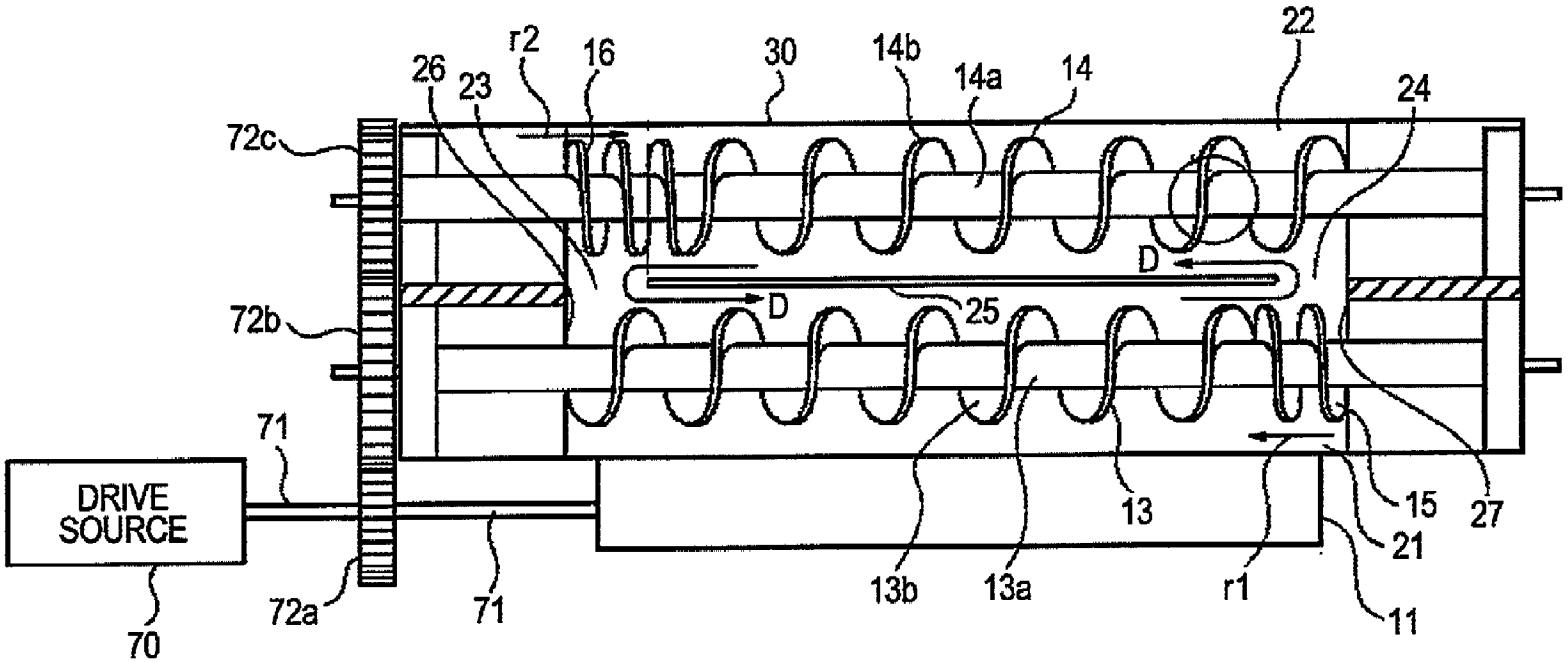
FIG. 4 is an explanatory view illustrating the developing apparatus to which is applied one exemplary embodiment of the present invention.

As shown in FIG. 4, the developing container 30 is divided by a partition 25 substantially into two spaces, i.e., the developing chamber (first developer containing chamber) 21 (positioned on the side closer to the developing sleeve 11) and a stirring chamber (second developer containing chamber) 22 (positioned on the side further away from the developing sleeve 11). In the first exemplary embodiment, the developing chamber 21 and the stirring chamber 22 are extended in the axial direction of the developing sleeve 11. The partition 25 is formed not to extend up to opposite inner side walls 26 and 27 of the developing container 30. With such an arrangement, a first communication part 23 and a second communication part 24 are formed to allow passage of the developer between the developing chamber 21 and the stirring chamber 22.

In the developing chamber 21 and the stirring chamber 22, a circulating unit is disposed to circulate the developer between the developing chamber 21 and the stirring chamber 22. The circulating unit includes a first screw 13 and a second screw 14 which are extended in the longitudinal direction of the developing chamber 21 and the stirring chamber 22, respectively, and which serve as conveying members to convey and stir the developer. With rotations of the first and second screws 13 and 14, the developer is mixed and stirred while circulating within the developing container 30. In the illustrated first exemplary embodiment, the developer is circulated within the developing apparatus 4 such that it is moved in the direction toward the front side from the backside of the drawing sheet of FIG. 2 in the developing chamber 21 and in the direction toward the backside from the front side of the drawing sheet of FIG. 2 in the stirring chamber 22 (namely, in the direction of an arrow D in FIG. 4).

In the developing apparatus 4 in the first exemplary embodiment, a drive motor provided in a main body of the image forming apparatus serves as a drive source 61 generating a driving force that is transmitted to the developing sleeve 11 through a rotary shaft 71 serving as a torque transmission unit. The driving force is further transmitted to the first and second screws 13 and 14 through gears 72*a*, 72*b* and 72*c* which constitute the torque transmission unit.

In the first exemplary embodiment, the first and second screws 13 and 14 include, respectively, rotary shafts 13*a* and 14*a* disposed to extend substantially parallel to the longitudinal direction of the developing chamber 21 and the stirring chamber 22, and spiral-shaped conveying members (blade-like members or spiral members) 13*b* and 14*b* provided around the rotary shafts 13*a* and 14*a*. In the first exemplary embodiment, the rotary shafts 13*a* and 14*a* of the first and second screws 13 and 14 each have a shaft diameter of 6 mm, and the spiral-shaped conveying members 13*b* and 14*b* each having a diameter of 16 mm are disposed on a shaft peripheral surface at intervals of 15 mm.

At respective downstream ends of the first and second screws 13 and 14 in the conveying direction of the developer, returning members 15 and 16 in the form of screws are disposed coaxially with the first and second screws 13 and 14 to convey the developer in opposite directions (denoted by arrows r1 and r2 in the drawing) to those given by the first and second screws 13 and 14. In other words, there are first and second returning members 15 and 16 constituted by arranging reversed-spiral-shaped conveying members (blade-like members) over respective peripheral surfaces of the rotary shafts 13*a* and 14*a*. With such an arrangement, the developer is pushed back in the direction opposed to the conveying direction of the developer (i.e., the direction of the arrow D in FIG. 4) at the respective downstream ends of the first and second screws 13 and 14 in the conveying direction of the developer, thus smoothing transfer of the developer in the first and second communication parts 23 and 24.

The toner in the two-component developer is consumed with the above-described developing operation. Therefore, the toner density of the developer in the developing container 30 is gradually reduced. To compensate for the reduction of the toner density, the toner is supplied (replenished) to the developing container 30 from the toner supply apparatus 49 shown in FIG. 3. The toner supply apparatus 49 has a toner container (toner supply tank or toner storage) 50 for containing the toner to be supplied to the developing apparatus 4. A toner supply port 51*b* is formed in the toner container 50 at its lower end as viewed on the drawing. In addition, the toner container 50 includes a toner supply screw 51*a* which serves as a toner supply unit for conveying the toner toward the toner supply port 51*b*.

Stated another way, when the image forming operation is repeated, the toner in the developing container 30 is consumed and the toner density of the developer is reduced. This means the necessity of supplying the toner, as required, to control the toner density to be maintained within a desired range so that the toner density approaches a target value. A toner supply control unit for controlling the toner supply includes the toner supply apparatus 49 and the control unit 80.

The first exemplary embodiment of the present invention includes a first toner supply control unit (of video counting type) configured to control a rotation time of the toner supply screw 51*a* based on the video count number of a density signal in an image information signal. The first exemplary embodiment also includes a second toner supply control unit (of patch detection type) configured to perform toner supply control based on a result of detecting a detection-adapted toner image, which is obtained by developing a detection-adapted electrostatic image formed on the photosensitive drum, by a density detecting unit (optical sensor 17) after transferring the detection-adapted toner image to the intermediate transfer member. The second toner supply control unit compares the detection result of the optical sensor with an initial reference signal stored in advance and corrects the driving time of the toner supply screw 51*a*, which has been determined by the first toner supply control unit, based on the comparison result. In other words, the first toner supply control unit and the second toner supply control unit are used in a combined manner.

In that case, the video count number and the detection result of the optical sensor provide information regarding the toner density of the developer. The information regarding the toner density of the developer is detected by the toner density detecting unit.

With such a combined method, the toner density is primarily controlled by the video counting type control (hereinafter referred to as a "video counting mode"). In the video counting mode, a level of an output signal from an image signal processing circuit is counted per pixel, and the count number is integrated over all pixels corresponding to the size of a document sheet. The video count number per document is thus determined (for example, a maximum video count number for one sheet of A4 size is 3884×106 at 400 dpi and 256 levels of gray).

The video count number corresponds to the expected amount of toner consumed, and a proper rotation time of the toner supply screw 51*a* is determined from a conversion table representing the correspondent relationship between the video count number and the rotation time of the toner supply screw 51*a*. The toner is supplied in accordance with the determined rotation time of the toner supply screw 51*a*.

In the first exemplary embodiment, the rotation time of the toner supply screw 51*a* is selected from among only integer times of a predetermined unit time that is set in advance (i.e., replenishment operation per replenishment basic unit).

Figure 5:
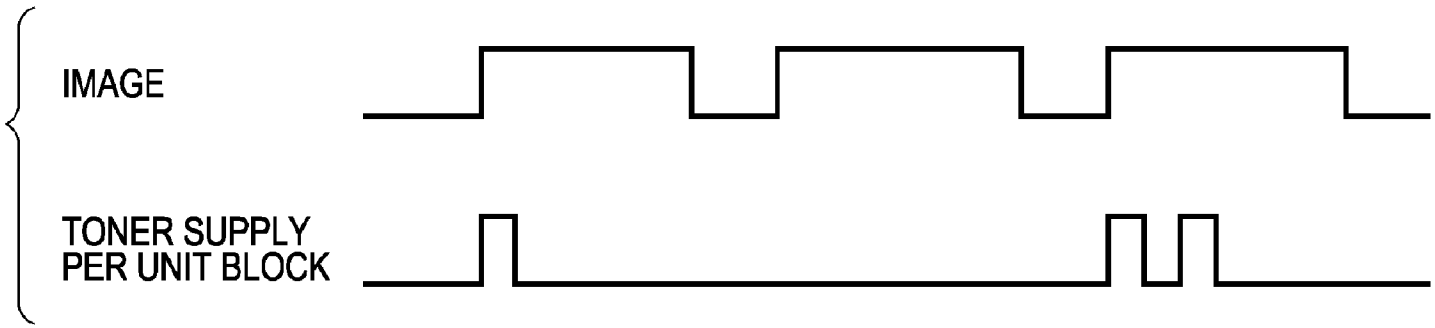
FIG. 5 is a chart illustrating a manner of replenishment operation per replenishment basic unit performed according to the present invention.

More specifically, in the first exemplary embodiment, the rotation time of the toner supply screw 51*a* per one replenishment basic unit is set to 0.4 sec, and the rotation time of the toner supply screw 51*a* for one image is limited to 0.4 sec or an integer time of 0.4 sec. FIG. 5 illustrates a practical manner for the toner supply.

Figure 6:
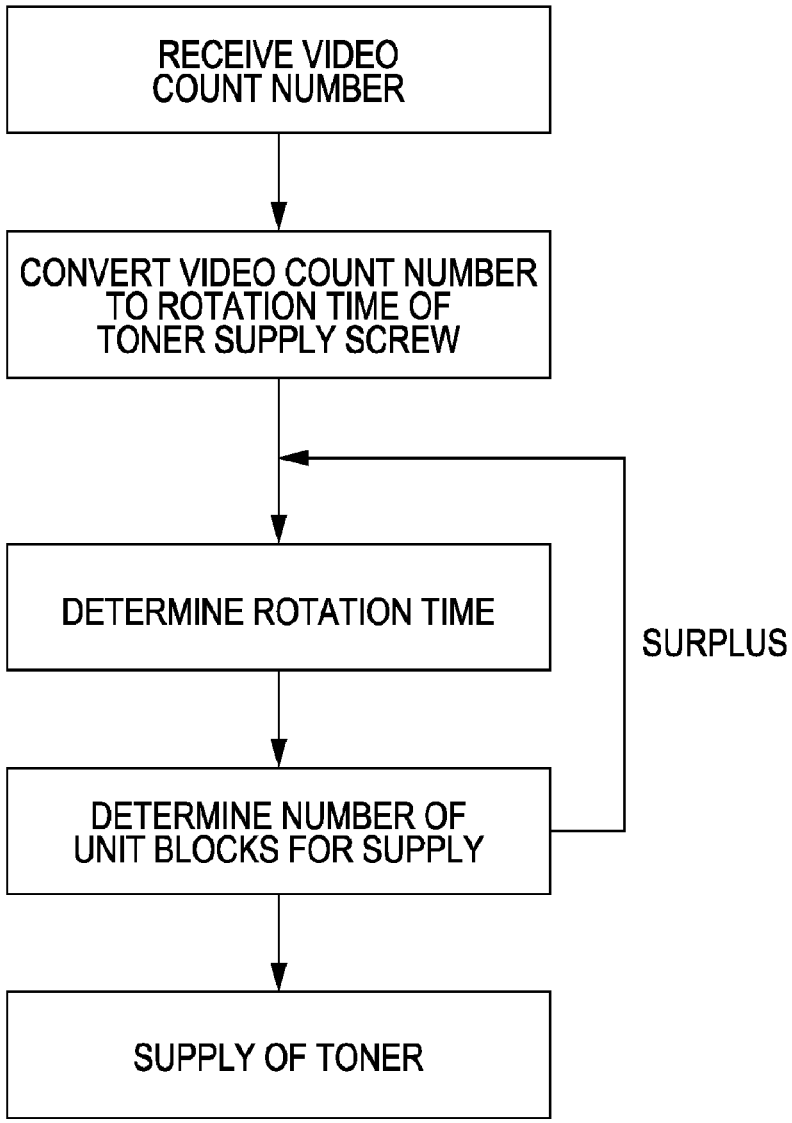
FIG. 6 is a flowchart illustrating toner supply in a video counting mode in the present invention.

For example, when 0.52 sec is obtained as the rotation time of the toner supply screw 51*a* from the video count number based on the conversion table, the number of replenishment basic units for replenishment operation, which is assigned for one image in the next image forming operation, is one. Therefore, the actual rotation time of the toner supply screw 51*a* is given as 0.4 sec and the toner supply corresponding to remaining 0.12 sec is reserved as a surplus. The reserved surplus is added to the rotation time of the toner supply screw 51*a*, which is obtained from the video count number in the next and further subsequent image forming operation. A flow of the above-described process is shown in FIG. 6.

An advantage resulting from limiting the rotation time of the toner supply screw 51*a* to only the integer time of the predetermined unit time is that the amount of toner supplied in each operation is stabilized.

If the toner is supplied directly in accordance with the rotation time of the toner supply screw 51*a* obtained from the video count number, the following problem arises. When the video count number is small, the corresponding rotation time of the toner supply screw 51*a* is very short. The short rotation time increases influences of the rising time and the falling time of the driving motor which is used to drive the toner supply screw 51*a*. This results in that the amount of toner supplied is unstable.

By always setting the constant rotation time as in the first exemplary embodiment, the amount of toner supplied is stabilized.

In the video counting mode, if there is a lag between the estimated amount of toner consumed and the actual amount of toner consumed, the toner density of the developer gradually deviates from a proper range. Such a deviation has to be avoided by correcting the amount of supplied toner with a patch detection method (hereinafter referred to as a "patch detection mode") at predetermined intervals. In the first exemplary embodiment, the predetermined interval is set to 30 sheets of small-size documents (e.g., A4 sheets in portrait orientation).

When the number of sheets processed by the image forming operation amounts to 30 and the timing of starting the patch detection mode is reached, an electrostatic latent image having a constant area and serving as a reference toner image is formed on the photosensitive drum. The electrostatic latent image is developed by applying a predetermined developing contrast voltage, and the developed reference toner image is transferred to the intermediate transfer member 116. The density of the reference toner image is detected by the optical sensor 17, i.e., the optical density detecting unit, which is disposed in an opposed relation to the intermediate transfer member 116. A detected density signal Vsig is compared with a reference signal Vref previously recorded in a memory. If $$Vsig - Vref < 0,$$

this is determined as indicating that the density of a patch image is low; namely, the toner density is low. An amount of toner to be supplied and a corresponding rotation time of the toner supply screw 51*a* are calculated from the difference between Vref and Vsig. Then, the rotation time of the toner supply screw 51*a* is corrected by adding the thus-calculated rotation time to the rotation time decided in the video counting mode. Conversely, if $$Vsig - Vref \geqq 0,$$

this is determined as indicating that the density of a patch image is high; namely, the toner density is high. An amount of toner having been supplied in excess and a corresponding stop time of the toner supply screw 51*a* are calculated from the difference between Vref and Vsig. Then, the rotation time of the toner supply screw 51*a* is corrected by subtracting the thus-calculated stop time from the rotation time decided in the video counting mode.

Figure 7:
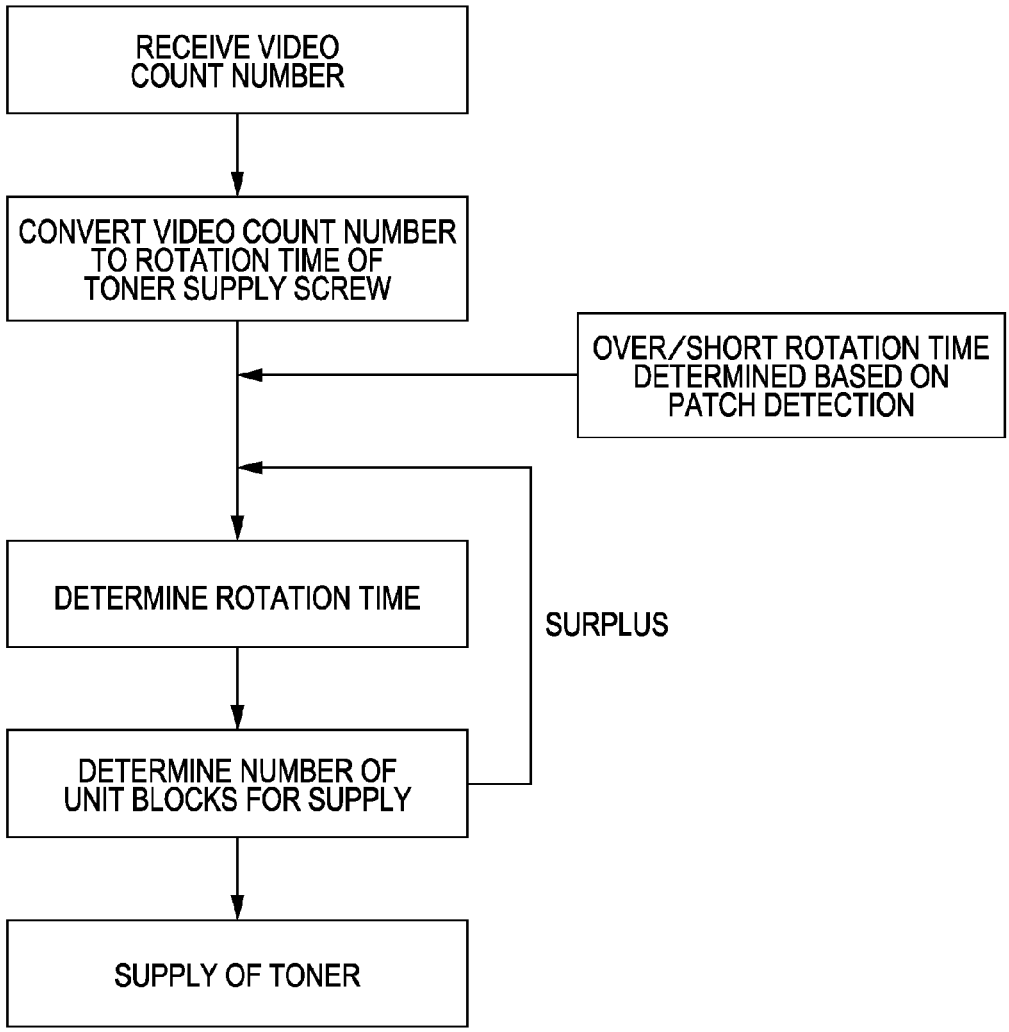
FIG. 7 is a flowchart illustrating toner supply with combined use of the video counting mode and a patch detection mode in the present invention.

With the above-described control, a deviation of the toner density can be corrected. FIG. 7 shows a process flow when the video counting mode and the patch detection mode are used in a combined manner.

Figure 8:
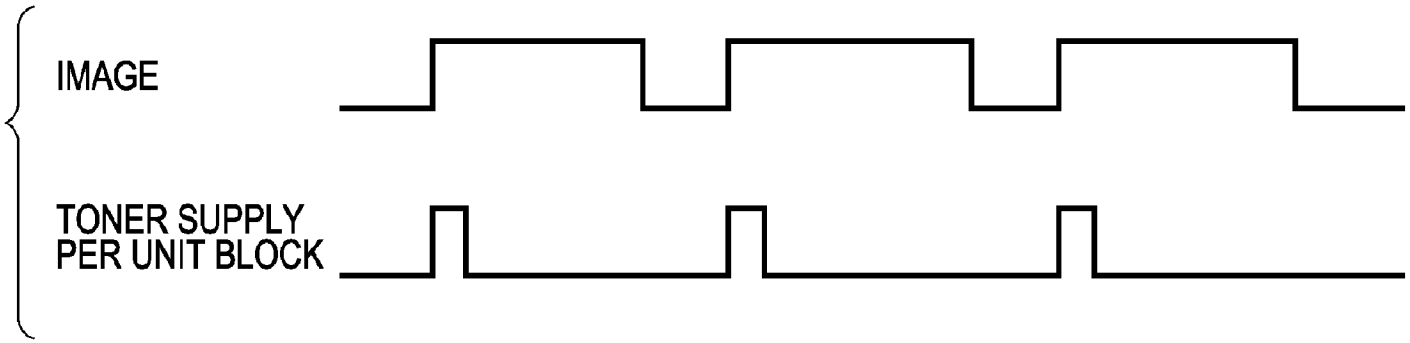
FIG. 8 is a chart illustrating that a manner of adding the number of replenishment basic units for replenishment operation differs between when a density signal of a reference toner image is not larger than a predetermined value and when the density signal of the reference toner image is larger than the predetermined value.

Moreover, when the rotation time of the toner supply screw 51*a* is increased based on the detection result in the patch detection mode, i.e., when the number of replenishment basic units for replenishment operation is added, only one replenishment basic unit is added for each image as shown in FIG. 8.

More specifically, when ten replenishment basic units for the toner supply are added based on the detection result in the patch detection mode, those ten replenishment basic units are added one for each image, instead of adding them at a time, such that the correction of adding the replenishment basic units is completed at the tenth image. That control is effective in avoiding an abrupt increase of the toner density in the developing apparatus, thereby preventing the occurrence of fogging and scattering.

The image forming apparatus of the first exemplary embodiment includes, as the transfer unit, the intermediate transfer belt 116. In the first exemplary embodiment, the primary transfer apparatus 5 is constituted by a transfer roller. The primary transfer roller 5 is brought into close contact with the photosensitive drum 2 by a predetermined pressing force. The primary transfer roller 5 is supplied from a power supply S3 with a transfer bias, e.g., +2 kV in the first exemplary embodiment, having a positive polarity opposite to the normally charged polarity of the toner, which is a negative polarity. With application of the transfer bias, the toner images formed on the surface of the photosensitive drums 2 are electrostatically transferred to the surface of the intermediate transfer member 116 in a successive manner.

Details of the cleaner-less system in the first exemplary embodiment will be described next with reference to FIG. 2.

The image forming apparatus of the first exemplary embodiment employs the cleaner-less system and does not include a dedicated cleaning apparatus for removing a slight amount of toner (hereinafter also referred to as the "after-transfer remaining toner") remaining on the surface of the photosensitive drum 2 after the transfer of the toner image to the intermediate transfer member 116. The after-transfer remaining toner on the surface of the photosensitive drum 2 is conveyed to the developing section through the charging section and the exposure section with the subsequent rotation of the photosensitive drum 2, and is removed and recovered by the developing apparatus 4 through the cleaning performed concurrently with the development (this is called the cleaner-less system). In the first exemplary embodiment, as described above, the developing sleeve 11 of the developing apparatus 4 is rotated in the direction opposed to the moving direction of the surface of the photosensitive drum 2 in the developing section. Such rotation of the developing sleeve 11 is advantageous in recovering the after-transfer remaining toner on the photosensitive drum 2. The after-transfer remaining toner on the photosensitive drum 2 passes the exposure section, and the exposure step is performed from above the after-transfer remaining toner. Usually, because the amount of the after-transfer remaining toner is small, a significant effect does not appear even when the exposure step is performed from above the after-transfer remaining toner. However, as described above, the after-transfer remaining toner contains the toner having the normally charged polarity, the reversed toner having the opposite polarity, and the toner having the reduced charge amount in a mixed state. Of those kinds of toners, the reversed toner having the opposite polarity and the toner having the reduced charge amount may attach to the contact charging roller 3 when they pass the charging section. This may result in that the charging roller 3 is contaminated with those toners beyond an allowable level and a charging failure is caused. In order to effectively remove and recover the after-transfer remaining toner on the photosensitive drum 2 at the same time as the developing operation by the developing apparatus 4, the charge amount of the after-transfer remaining toner is an important factor. More specifically, the after-transfer remaining toner on the photosensitive drum 2, which is carried to the developing section, is desired to have the normally charged polarity and to have such a charge amount that the electrostatic latent image on the photosensitive member 2 can be developed by the developing apparatus 4. If the charge polarity of the after-transfer remaining toner is reversed and/or if the toner charge amount is improper, the after-transfer remaining toner cannot be removed and recovered from the photosensitive member 2 to the developing apparatus 4, thus causing a failed image.

The above-described problem is overcome by providing the charging auxiliary unit 6 which comprises the following two units 6*a* and 6*b*. A remaining toner uniformalizing unit (remaining developer uniformalizing unit) 6*a* is configured to uniformalize the after-transfer remaining toner on the photosensitive drum 2 and is disposed at a position downstream of the transfer section in the rotating direction of the photosensitive drum 2. Further, a toner charge amount control unit (developer charge amount control unit) 6*b* is disposed at a position downstream of the remaining toner uniformalizing unit 6*a* in the rotating direction of the photosensitive drum 2 and upstream of the transfer section in the rotating direction of the photosensitive drum 2. The toner charge amount control unit 6*b* serves to evenly charge the after-transfer remaining toner so as to have the negative polarity, i.e., the normal polarity. Generally, the after-transfer remaining toner left on the photosensitive drum 2 without being transferred contains the reversed toner having the opposite polarity and the toner having the improper charge amount in a mixed state. In view of such a situation, the remaining toner uniformalizing unit 6*a* cancels the charges of the after-transfer remaining toner, and the toner charge amount control unit 6*b* charges again the after-transfer remaining toner to the normal polarity. In other words, the remaining toner uniformalizing unit 6*a* and the toner charge amount control unit 6*b* provide a capability to vary the charge amount of the toner on the photosensitive drum 2. With the use of the units 6*a* and 6*b*, the after-transfer remaining toner can be effectively prevented from attaching to the charging roller 3, and the after-transfer remaining toner can be completely removed and recovered in the developing apparatus 4. Accordingly, the occurrence of a ghost image due to an image pattern of the after-transfer remaining toner is also avoided. In the first exemplary embodiment, each of the remaining toner uniformalizing unit 6*a* and the toner charge amount control unit 6*b* includes a conductive brush-like member serving as an auxiliary charging member, and is disposed such that the brush-like member contacts the surface of the photosensitive drum 2. The brush-like member can be formed, for example, with a brush length of 1 - 10 mm, a brush density of 1-500,000/inch$^2$, a brush diameter of 2-12 denier, and brush resistance of $10^{-2}$-$10^{12}$ Ω·cm. A DC voltage having a positive polarity is applied from a power supply S4, which serves as a voltage applying unit, to the remaining toner uniformalizing unit 6*a* of the charging auxiliary unit, and a DC voltage having a negative polarity is applied from a power supply S5 to the toner charge amount control unit 6*b*. The magnitudes of the DC voltages applied to the units 6*a* and 6*b* are changed depending on an absolute moisture amount calculated from the temperature and the relative humidity which are detected by temperature and humidity sensors installed in the image forming apparatus. In an environment with the temperature of 23° C. and the absolute moisture amount of 10.5 g/m$^3$, for example, a DC voltage of +100 V is applied to the remaining toner uniformalizing unit 6*a* and a DC voltage of −950 V is applied to the toner charge amount control unit 6*b*. When the toner remaining on the photosensitive drum 2 after the transfer of the toner image to the intermediate transfer belt 116 in the transfer section reaches a contact region between the remaining toner uniformalizing unit 6*a* and the photosensitive drum 2, the charge amount of the after-transfer remaining toner is uniformalized to about 0 μC/g by the remaining toner uniformalizing unit 6*a*. Then, the after-transfer remaining toner on the surface of the photosensitive drum 2, which has the charge amount uniformalized by the remaining toner uniformalizing unit 6*a*, reaches a contact region between the toner charge amount control unit 6*b* and the photosensitive drum 2. The charge polarity of the after-transfer remaining toner is made even to the negative polarity, i.e., the normal polarity, by the toner charge amount control unit 6*b*. By making the charge polarity of the after-transfer remaining toner even to the negative polarity, i.e., the normal polarity, the following advantages are obtained. When the surface of the photosensitive drum 2 is charged from above the after-transfer remaining toner in the contact region (charging section) between the charging roller 3 and the photosensitive drum 2, an image force imposed on the after-transfer remaining toner toward the photosensitive drum 2 is increased. As a result, the after-transfer remaining toner can be prevented from being attached to the charging roller 3. For that reason, the charge amount applied to the after-transfer remaining toner by the toner charge amount control unit 6*b* is desired to be about twice or more than the toner charge amount applied in the developing step, and it is about −50 μC/g in the environment with the temperature of 23° C. and the absolute moisture amount of 10.5 g/m$^3$. The charging auxiliary apparatus 6 includes a reciprocating mechanism (not shown) which is driven in sync with the driving of the photosensitive drum 2. The reciprocating mechanism oscillates the charging auxiliary member in the direction of main scanning such that the after-transfer remaining toner on the photosensitive drum 2 and later-described abrasive particles can be efficiently collected to the remaining toner uniformalizing unit 6*a* and the toner charge amount control unit 6*b*.

The recovery of the after-transfer remaining toner in the developing step will be described next. In the developing apparatus 4, the after-transfer remaining toner is recovered and cleaned concurrently with the development. The charge amount (average value) of the toner used to develop the electrostatic latent image on the photosensitive drum 2 is set to about −25 μC/g in the environment with the temperature of 23° C. and the absolute moisture amount of 10.5 g/m$^3$. To ensure that the after-transfer remaining toner on the photosensitive drum 2 is sufficiently recovered, the charge amount of the after-transfer remaining toner reaching the developing apparatus 4 is desired to be in the range of about 15-35 μC/g. As described above, however, the after-transfer remaining toner is charged by the toner charge amount control unit 6*b* to the negative polarity at a higher level, i.e., −50 μC/g, for the purpose of preventing the toner attachment to the charging roller 3. It is therefore required to cancel the charge of that after-transfer remaining toner for the recovery in the developing apparatus 4. Herein, an AC voltage (frequency=1.3 kHz and peak-to-peak voltage Vpp=1.5 kV) is applied to the charging roller 3 for charging the surface of the photosensitive drum 2. At the same time as when the charging roller 3 charges the surface of the photosensitive drum 2, the charge of the after-transfer remaining toner on the photosensitive drum 2 is canceled by applying an AC voltage. Under a certain AC voltage condition, the charge amount of the after-transfer remaining toner, which has been about −50 μC/g, is reduced to about −30 μC/g after passing through the charging section. In the developing step, therefore, the after-transfer remaining toner attached to an area (non-image area) of the photosensitive drum 2 in which the toner is not to be attached is recovered to the developing apparatus 4.

Thus, the following points can be achieved. (i) The after-transfer remaining toner conveyed to the charging section from the transfer section with the rotation of the photosensitive drum 2 is charged evenly to the negative polarity, i.e., the normal polarity, by the toner charge amount control unit 6*b*, whereby the after-transfer remaining toner is prevented from attaching to the charging roller 3. (ii) The photosensitive drum 2 is charged to a predetermined potential by the charging roller 3. At the same time, the charge amount of the after-transfer remaining toner having the negative polarity, which has been provided by the toner charge amount control unit 6*b*, is controlled to a level comparable to that used to develop the electrostatic latent image on the photosensitive drum 2 by the developing apparatus 4. As a result, the after-transfer remaining toner can be efficiently recovered in the developing apparatus 4.

The above-described cleaner-less system, in particular, the cleaning performed concurrently with the development, eliminates the need of providing a dedicated cleaning apparatus which has been generally used in the past. Accordingly, the toner can be reused without generating waste toner, troublesome maintenance work can be eliminated, and the apparatus size can be greatly reduced. Additional advantages are in ensuring preservation of the environment and promoting effective utilization of resources.

Figure 9:
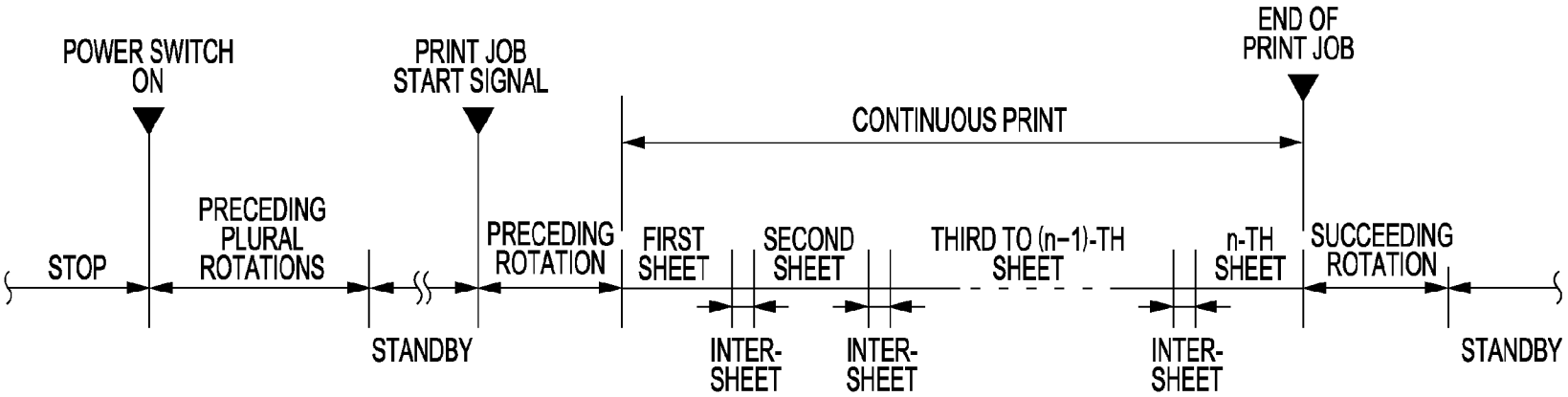
FIG. 9 is a schedule chart illustrating operation steps of the image forming apparatus in the present invention.

FIG. 9 is a schedule chart illustrating operation steps of the image forming apparatus.

(a): Preceding Multi-Rotation Step

This is a start (boot) operation period (warming-up period) of the image forming apparatus. Upon turning-on of a main power switch of the image forming apparatus, a main motor of the image forming apparatus is started to execute necessary preparatory operations for various process units.

(b): Standby

After the completion of a predetermined start operation period, the driving of the main motor is stopped and the image forming apparatus is held in the standby state until a print job start signal is input.

(c): Preceding Rotation Step

In response to the input of the print job start signal, the main motor is driven again to execute necessary pre-print-job operations of the various process units.

Practically, the operations are executed in the following sequence. (1) The image forming apparatus receives the print job start signal. (2) A formatter develops an image (an image developing time is changed depending on the data amount of the image and the processing speed of the formatter). (3) The preceding rotation step is started.

If the print job start signal is input during the above (1), i.e., during the preceding multi-rotation step, the process flow is shifted to the preceding rotation step at once after the completion of the preceding multi-rotation step while skipping the above (2), i.e., the standby state.

(d): Execution of Print Job

When the preceding rotation step is completed in a predetermined manner, the image forming process is executed continuously and a recording material having finished the image forming process is output.

In the case of a continuous print job, the image forming process is repeated so that recording materials having finished the image forming process are successively output in a predetermined number of sheets.

(e): Inter-Sheet Step

This corresponds to an interval between a tailing end of one recording material P and a leading end of the next recording material P in the case of a continuous print job. In other words, this step is a period during which no sheets pass through the transfer section and the fusing apparatus.

(f): Succeeding Rotation Step

The main motor is continuously driven for a predetermined time even after one recording material having finished the image forming process is output in the case of a print job for only one sheet, and even after the last recording material having finished the image forming process in a continuous print job is output in the case of the continuous print job. With the continued driving of the main motor, necessary post-print-job operations of the various process units are executed.

(g): Standby

When the succeeding rotation step is completed in a predetermined manner, the driving of the main motor is stopped and the image forming apparatus is held in the standby state until a next print job start signal is input.

In the above description, (d): "Execution of Print Job" correspond to a period of image formation, while (a): "Preceding Multi-Rotation Step", (c): "Preceding Rotation Step", (e): "Inter-Sheet Step", and (f): "Succeeding Rotation Step" correspond to a period of non-image formation.

The term "period of non-image formation" means at least one of the Preceding Multi-Rotation Step, the Preceding Rotation Step, the Inter-Sheet Step, and the Succeeding Rotation Step, or means at least a predetermined time within any of those steps.

While at least the photosensitive drum 2 and the developing sleeve (roller) 11 are rotated in the period of non-image formation, predetermined voltages are applied to the charging roller 3 and the developing sleeve 11 such that a predetermined potential difference (Vback potential) is produced between the photosensitive drum 2 and the developing sleeve 11. This is intended to prevent the occurrence of fogging and carrier attachment due to the rotation of the photosensitive drum 2 and the developing sleeve 11 during the period of non-image formation. Practically, in the first exemplary embodiment, the Vback potential is set to 200 V by setting the surface potential (Vd) of the photosensitive drum 2 to −500 V and the developing bias voltage (Vdc) to −300 V.

Measurement of a current amount in the remaining toner uniformalizing unit 6*a* according to the first exemplary embodiment will be described next.

Figure 2:
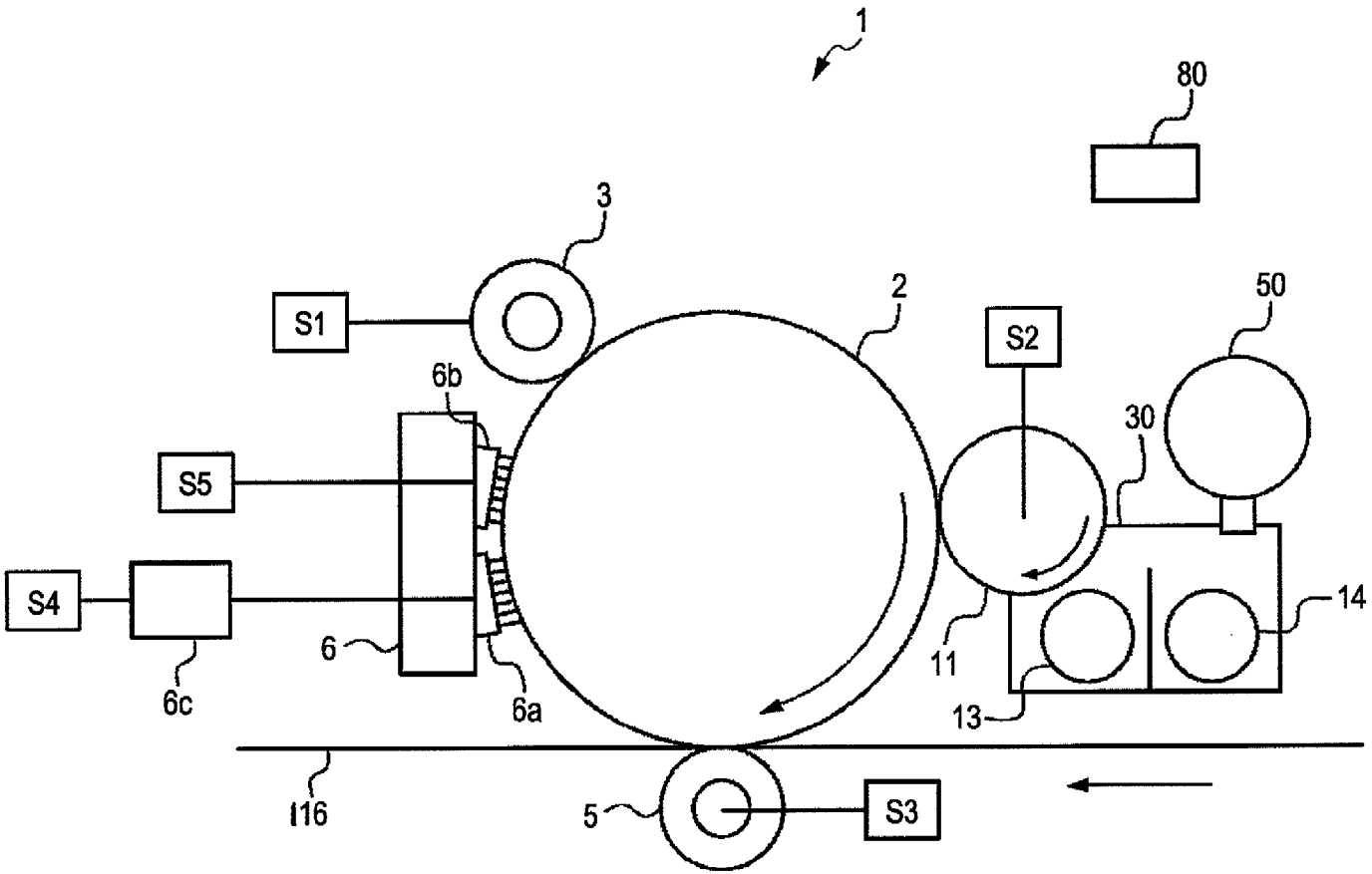
FIG. 2 is an explanatory view illustrating a cleaner-less system in the image forming apparatus according to one exemplary embodiment of the present invention.

As shown in FIG. 2, the image forming apparatus of the first exemplary embodiment includes a current detecting unit 6*c* configured to detect a current amount in the remaining toner uniformalizing unit 6*a*. The timing of detecting the current amount is set such that the detection is performed once for each of the Preceding Rotation Step, the Inter-Sheet Step, and the Succeeding Rotation Step which correspond to the period of non-image formation. The reason why the current amount is detected during the period of non-image formation is that, since the Vback potential is in a uniform state over an entire area of the photosensitive drum 2 in both the direction of main scanning and the direction of sub-scanning during the period of non-image formation, the current amount can be always detected with good accuracy under the same potential condition. On the other hand, during the period of image formation, the potentials of the photosensitive drum in the direction of main scanning and the direction of sub-scanning become uneven depending on an image pattern to be formed. It is hence difficult to accurately detect the occurrence of fogging of the reversed toner.

Figure 10:
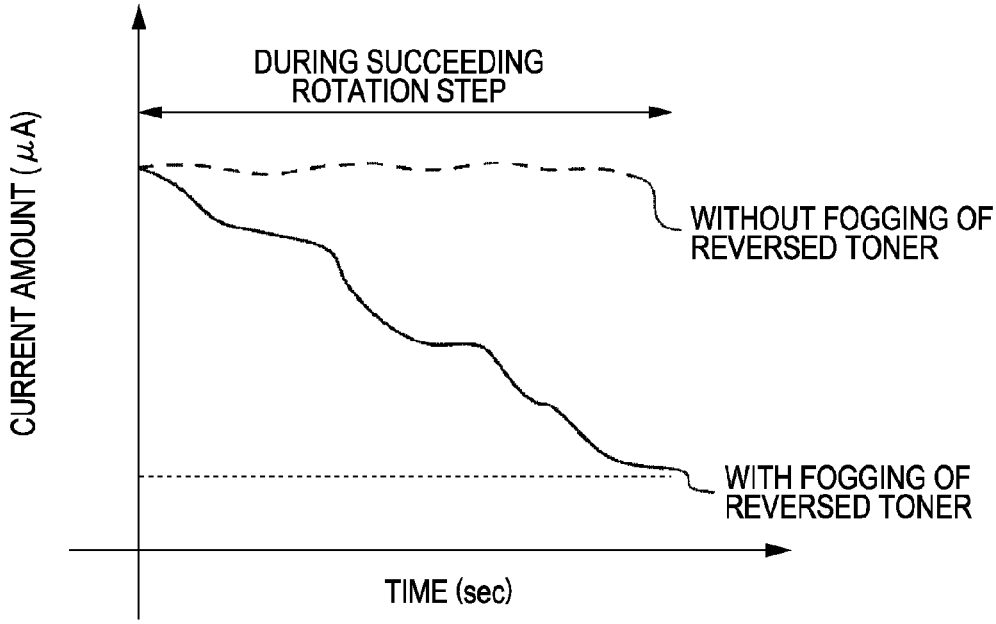
FIG. 10 is a graph illustrating a variation of a current value in a charging auxiliary member when fogging of a reversed toner is caused in one exemplary embodiment.

FIG. 10 illustrates changes of the current amount in the remaining toner uniformalizing unit 6*a* when the fogging of the reversed toner is actually caused in the Succeeding Rotation Step. As seen from FIG. 10, when the fogging of the reversed toner occurs, the current amount is gradually reduced depending on the amount of toner attached to the remaining toner uniformalizing unit 6*a*.

The current amount in the remaining toner uniformalizing unit 6*a* is detected within a reference time for each of the Preceding Rotation Step, the Inter-Sheet Step, and the Succeeding Rotation Step. If the difference between a maximum value and a minimum value of the current amount detected in each of those Steps successively exceeds a threshold (reference value) over a reference number of times (5 in the first exemplary embodiment), this is determined as indicating that the fogging of the reversed toner is caused in the image forming unit. Then, the value of the above-described reference signal Vref in the patch detection mode is corrected to reduce the toner density.

A process of detecting the current amount and correcting the patch reference signal Vref in the Inter-Sheet Step, which represents one example of the non-image formation period, will be described in detail with reference to flowcharts of FIGS. 11 and 12.

First, the current amount in the remaining toner uniformalizing unit 6*a* is successively measured within a predetermined time (0.4 sec in the first exemplary embodiment) during the Inter-Sheet Step (S1201). Next, as shown in FIG. 11, a difference F(H−L) between a maximum value F(H) and a minimum value F(L) of the measured current amount is calculated (S1202). If F(H−L) is less than a reference value of 0.5 μA, this is determined as indicating that the fogging of the reversed toner is not caused. Then, the image forming operation is continued as it is (S1203, S1206). On the other hand, if F(H−L) successively exceeds 0.5 μA five times (S1203, S1204), this is determined as indicating that the fogging of the reversed toner is caused. Then, the value of the reference signal Vref in the patch detection mode is reduced by 20 levels (corresponding to 0.5% in terms of the toner density) (i.e., Vref−20) (S1205).

Figure 11:
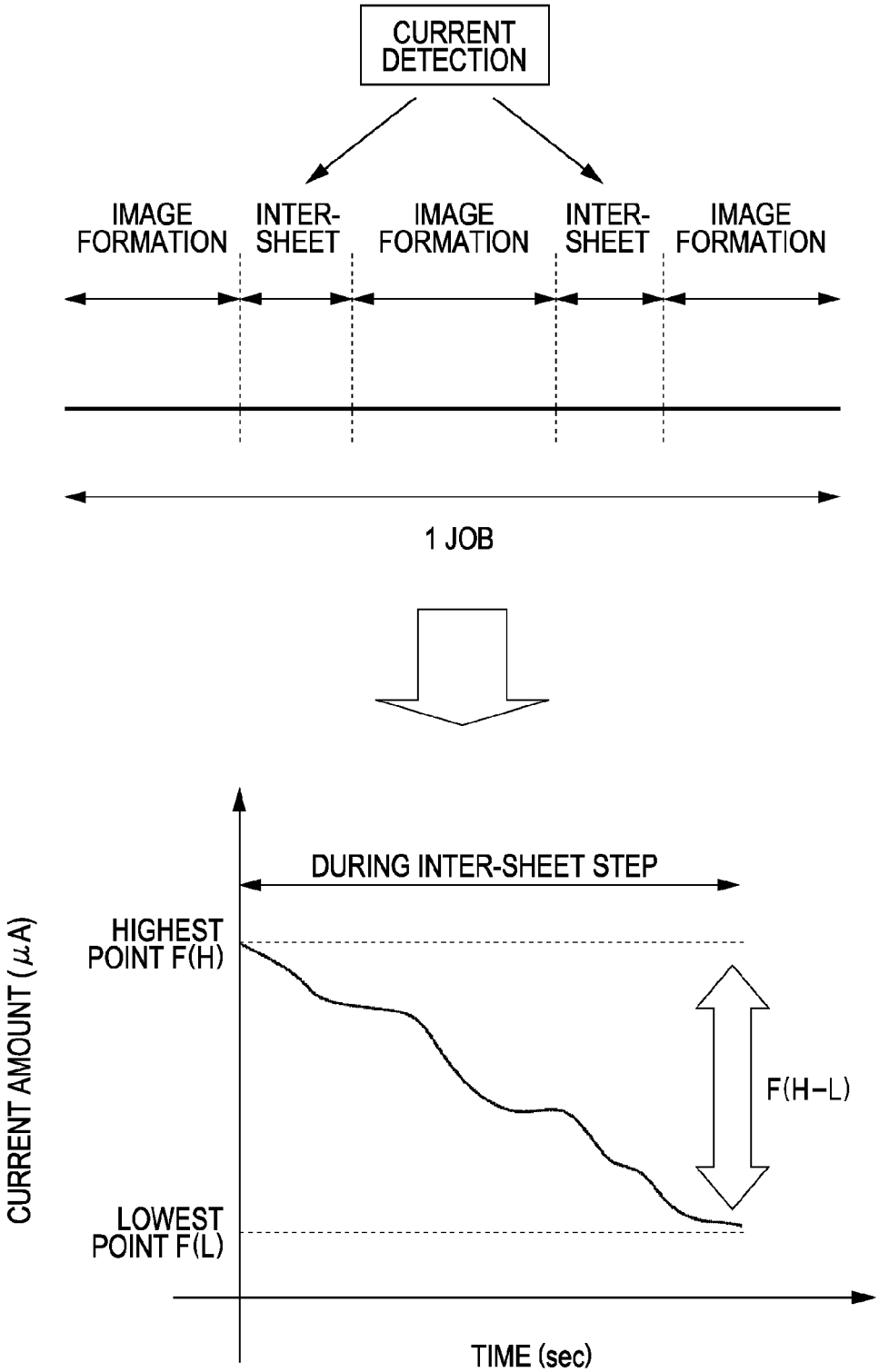
FIG. 11 is a graph illustrating the timing of detecting the current value in the charging auxiliary member and a method of detecting it in one exemplary embodiment.
Figure 12:
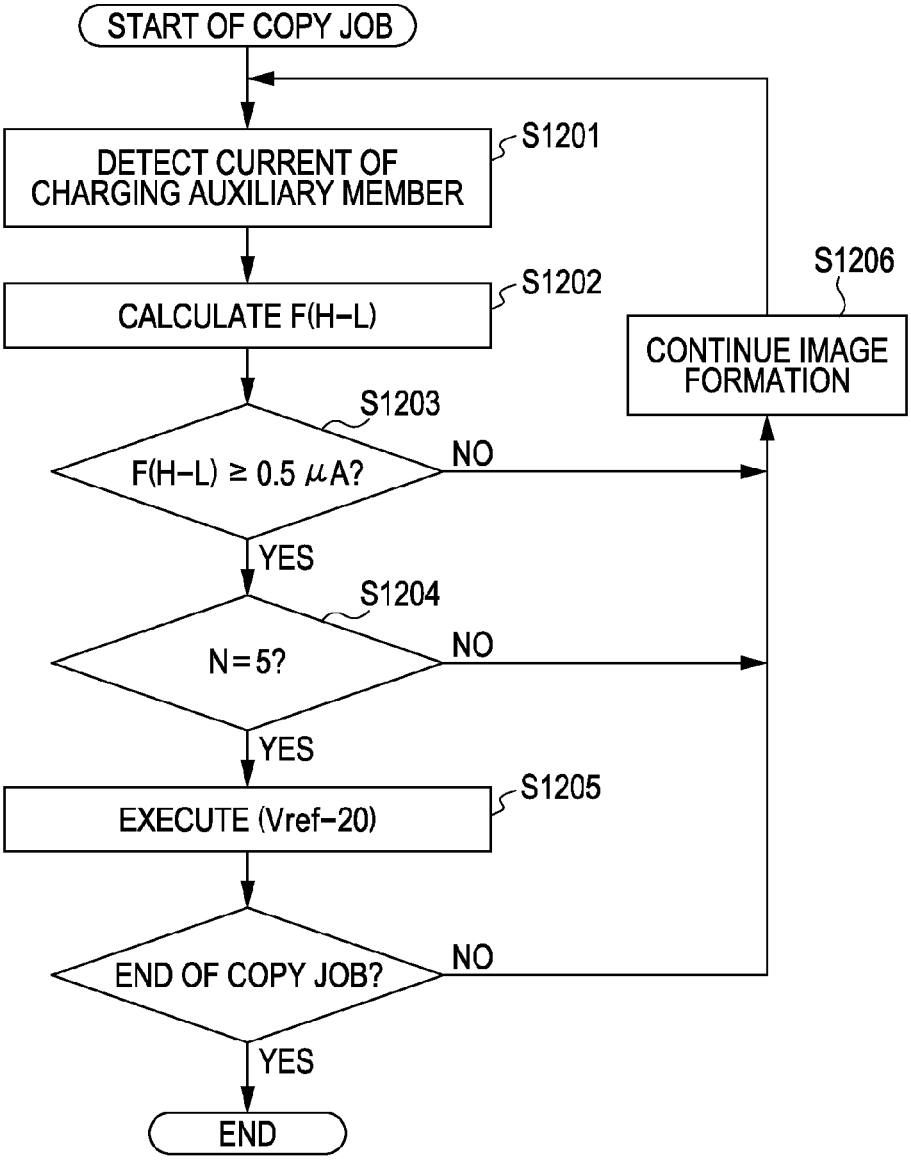
FIG. 12 is a flowchart for correcting a patch reference value Vref in the first, third and fourth exemplary embodiments of the present invention.

In the first exemplary embodiment, as shown in FIG. 11, the difference F(H−L) between the maximum value F(H) and the minimum value F(L) of the measured current amount is calculated. If it is tried to detect the occurrence of the fogging of the reversed toner by using only an absolute value of the current amount, the following problem arises. For example, when a large amount of the after-transfer remaining toner is generated in the image forming apparatus, the current amount (value) in the charging auxiliary member is possibly reduced due to the other factor than the fogging of the reversed toner. Accordingly, it is very difficult to detect the occurrence of the fogging of the reversed toner by using only the absolute value of the current amount. By calculating the difference F(H−L) between the maximum value F(H) and the minimum value F(L) of the measured current amount, only a decrease of the current amount caused by the occurrence of the fogging of the reversed toner can be correctly detected. As a result, the occurrence of the fogging of the reversed toner can be detected with good accuracy.

In the first exemplary embodiment, when the value of the reference signal Vref is corrected upon the determination that the fogging of the reversed toner is caused, the detection of the current amount is not performed until the image forming process is repeated for subsequent ten sheets. The reason is that, after the correction of Vref, there is a time lag until the toner density is actually increased with the toner supply.

Also, in the first exemplary embodiment, if it is determined that the fogging of the reversed toner is caused, the value of the patch reference signal Vref is reduced in units of 20 levels. However, when the patch reference signal Vref is corrected so many times, the toner density may be reduced to such an extent as causing a risk of carrier attachment and image unevenness. In the first exemplary embodiment, therefore, if it is determined that the fogging of the reversed toner is still caused even after correcting the patch reference signal Vref six times (corresponding to 3% in terms of the toner density), this is determined as indicating the abnormal state of the image forming unit. Then, a message representing the apparatus abnormality is displayed on a display unit 90.

As described above, when the fogging of the reversed toner is detected, the toner density in the developing apparatus can be reduced by correcting the value of the reference signal Vref. As a result, the charge amount of the carrier can be increased and the fogging of the reversed toner can be prevented. While the above description is made in connection with the case of detecting the current amount and correcting the reference signal Vref during the Inter-Sheet Step, the process of detecting the current amount and correcting the reference signal Vref can also be performed in a similar manner during the Preceding Rotation Step and the Succeeding Rotation Step. Stated another way, during the period of non-image formation, the current amount is measured within a predetermined time (0.4 sec in the first exemplary embodiment). If F(H−L) successively exceeds 0.5 μA five times, this is determined as indicating that the fogging of the reversed toner is caused. Then, the value of the reference signal Vref in the patch detection mode is reduced by 20 levels.

Thus, the occurrence of the fogging of the reversed toner is determined by detecting the current amount in the remaining toner uniformalizing unit 6*a* during the period of non-image formation. If it is determined that the fogging of the reversed toner is caused, the toner density is made appropriate by correcting the value of the reference signal in the patch detection mode. As a result, the charge amount of the carrier can be increased and the fogging of the reversed toner can be prevented. The image forming apparatus can be hence provided which stably operates without causing a tint variation, undesired streaks in the image due to a charging failure, etc.

Figure 17:
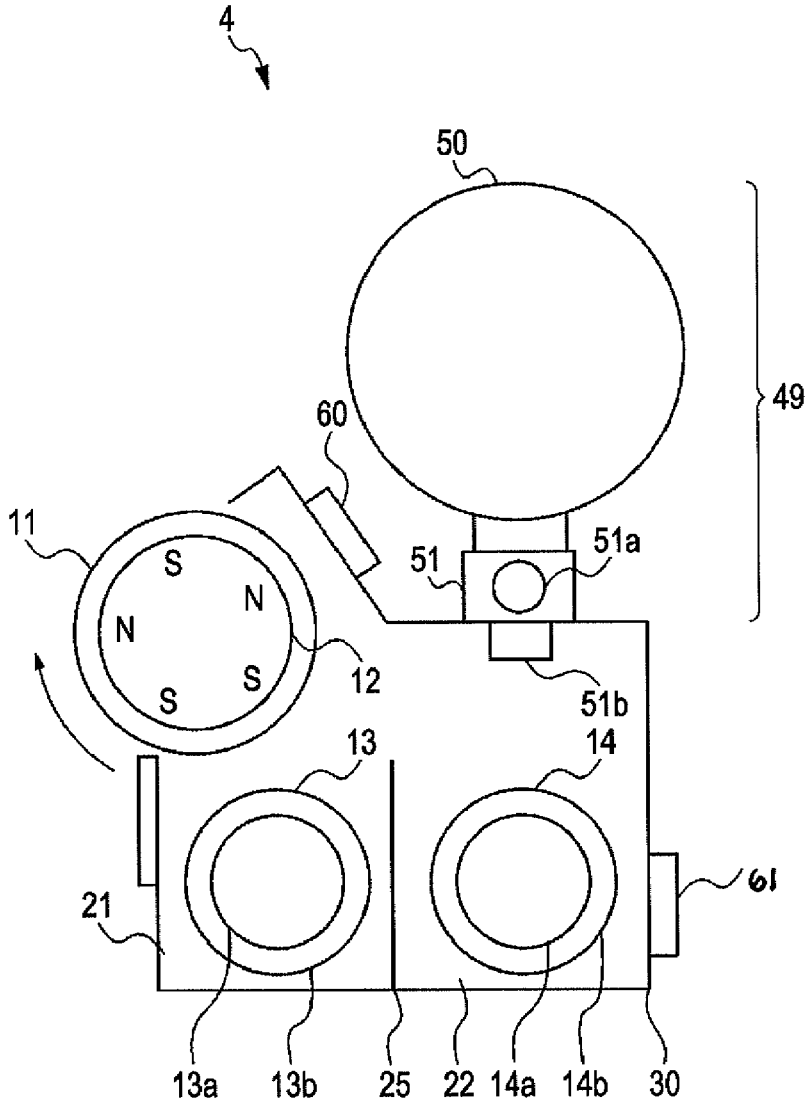
FIG. 17 is a schematic view illustrating another form of a toner density detecting unit.

While the unit of controlling the toner density within the developing container employs the video counting mode and the patch detection mode in a combined manner in the first exemplary embodiment, the present invention is not limited to such control. For example, as shown in FIG. 17, the toner density detecting unit can be constituted by an optical sensor 60 configured to measure changes of light reflection density of the toner in the developing apparatus. Alternatively, the toner density detecting unit can be constituted by a permeability sensor 70 configured to measure changes of permeability of the toner in the developing apparatus. Thus, the toner density of the developer in the developing apparatus is controlling by using any of those toner density detecting units. When the detection result of the current amount in the charging auxiliary unit indicates that the fogging of the reversed toner is caused, the value of the reference signal for the toner density detecting unit is corrected. The present invention can also be applied to the control for making appropriate the toner density in such a manner.

Also, in the first exemplary embodiment, the difference F(H−L) between the maximum value F(H) and the minimum value F(L) of the detected current amount successively exceeds the reference value five times, this is determined as indicating that the fogging of the reversed toner is caused. However, the condition as to whether F(H−L) successively exceeds the reference value five times is intended to increase the detection accuracy, and the number of times at which F(H−L) successively exceeds the reference value is not limited to particular one, i.e., five.

Further, in the first exemplary embodiment, the operation of detecting the fogging is performed during the period of non-image formation. However, the operation of detecting the carrier attachment can also be performed as a special sequence, for example, by temporarily interrupting the copy operation during the copy job and forming the Vback potential over the entire surface of the photosensitive drum. Further, the operation of detecting the fogging of the reversed toner can also be performed by periodically setting the time of the Preceding Rotation Step, the Inter-Sheet Step, and the Succeeding Rotation Step to be longer than that in the ordinary process, thus setting a longer region under the Vback potential.

The construction of the image forming apparatus is not limited to the above-described one, shown in FIG. 1, according to the first exemplary embodiment. For example, the present invention can also be applied to an image forming apparatus utilizing a direct transfer process in which the toner image is directly transferred to the recording medium from the photosensitive drum without using the intermediate transfer member.

The dimensions, materials, shapes, relative positions, etc. of components of the image forming apparatus, which have been described above in the first exemplary embodiment, are merely by way of example and are not purported to restrict the scope of the invention unless otherwise specified.

Second Exemplary Embodiment

A second exemplary embodiment of the present invention will be described next. The basic construction and operation of the image forming apparatus according to the second exemplary embodiment are the same as those in the first exemplary embodiment. Therefore, components having the same or equivalent functions and constructions are denoted by the same symbols and a detailed description of those components is not repeated here. The following description is made of only points specific to the second exemplary embodiment.

In the foregoing first exemplary embodiment, the current amount in the charging auxiliary unit is detected, and if it is determined from the detection result that the fogging of the reversed toner is caused, the value of the reference signal in the patch detection mode or the toner density detection mode is corrected. With such correction, the toner density is made appropriate so as to suppress the fogging of the reversed toner.

In contrast, in the second exemplary embodiment, the current amount in the charging auxiliary unit is detected, and if it is determined from the detection result that the fogging of the reversed toner is caused, the Vback potential is corrected so as to suppress the fogging of the reversed toner. Details of that process will be described below.

In the second exemplary embodiment, as in the first exemplary embodiment, the Vback potential during the period of non-image formation is set to 200 V by setting the surface potential (Vd potential) of the photosensitive drum 2 to −500 V and the developing bias voltage (Vdc potential) to −300 V. In each of the Preceding Rotation Step, the Inter-Sheet Step, and the Succeeding Rotation Step, the current amount (value) in the remaining toner uniformalizing unit 6*a* is detected. If the difference between the maximum value and the minimum value of the current detected in each of those Steps successively exceeds the threshold five times, this is determined as indicating that the fogging of the reversed toner is caused in the image forming unit. Then, the Vback potential is corrected.

Figure 13:
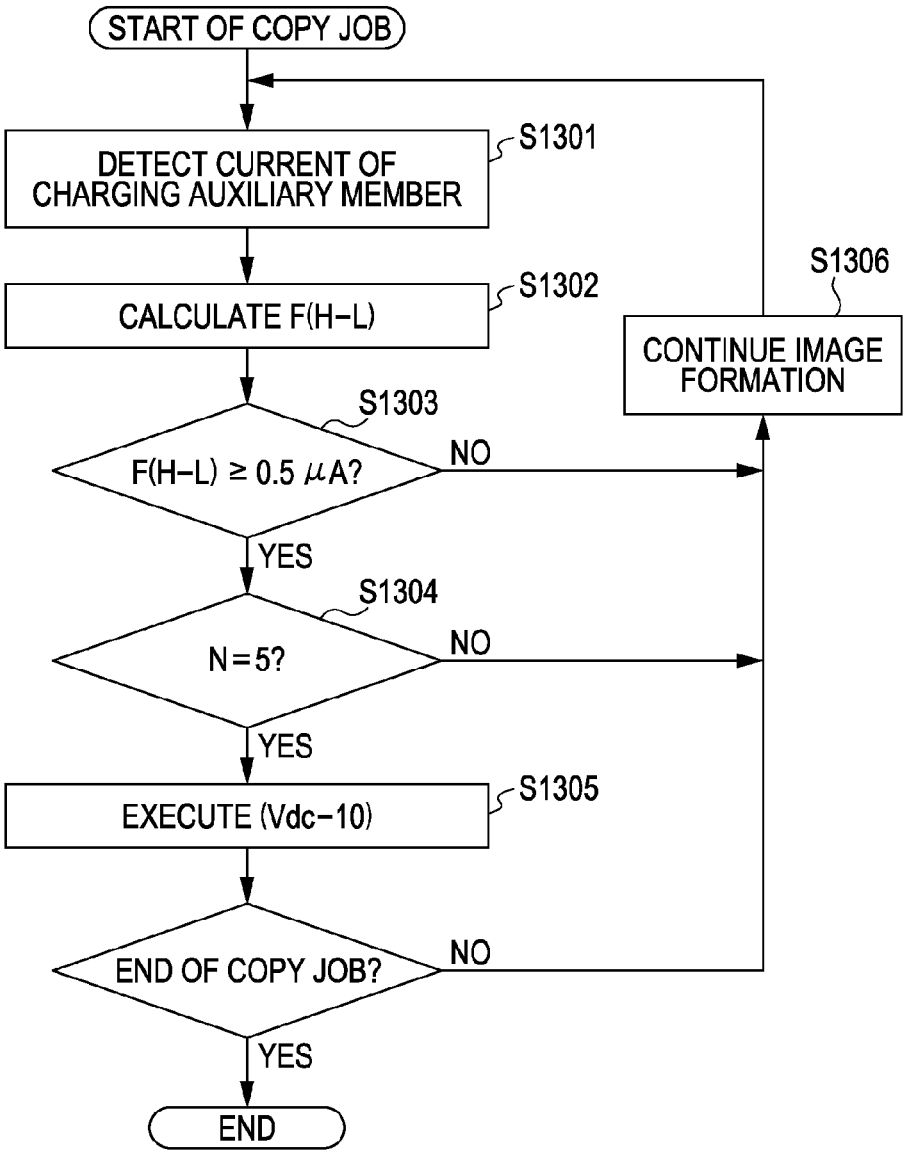
FIG. 13 is a flowchart for correcting a Vback potential in the second exemplary embodiments of the present invention.

Details will be described with reference to a flowchart of FIG. 13. First, the current amount in the toner charge amount control unit 6*b* is successively measured within a predetermined time (0.4 sec in the second exemplary embodiment) during the Inter-Sheet Step (S1301). Next, a difference F(H−L) between a maximum value F(H) and a minimum value F(L) of the measured current amount is calculated (S1302). If F(H−L) is less than a reference value of 0.5 μA, this is determined as indicating that the fogging of the reversed toner is not caused (S1303). Then, the image forming operation is continued as it is (S1306). On the other hand, if F(H−L) successively exceeds 0.5 μA five times, this is determined as indicating that the fogging of the reversed toner is caused (S1304). Then, the voltage Vdc applied to the developing roller (sleeve) is reduced by 10 volts (S1305). Stated another way, the development potential Vdc is changed from −300 V to −310 V levels. As a result, the Vback potential is reduced from 200 V to 190 V, whereby the fogging of the reversed toner can be suppressed.

As described above, when the fogging of the reversed toner is detected, the fogging of the reversed toner can be prevented by reducing the Vback potential. While the above description is made in connection with the case of detecting the current amount and correcting the Vback potential during the Inter-Sheet Step, the process of detecting the current amount and correcting the Vback potential can also be performed in a similar manner during the Preceding Rotation Step and the Succeeding Rotation Step. Stated another way, the current amount is detected within a predetermined time during each of the Preceding Rotation Step, the Inter-Sheet Step, and the Succeeding Rotation Step. If F(H−L) successively exceeds 0.5 μA five times, this is determined as indicating that the fogging of the reversed toner is caused. Then, the voltage Vdc applied to the developing roller (sleeve) is corrected by 10 V.

In the second exemplary embodiment, if it is determined that the fogging of the reversed toner is caused, the Vback potential is reduced in units of 10 V. However, when the Vback potential is corrected so many times, there arises a risk that the Vback potential cannot be sufficiently applied and fogging of the normal toner is caused. In the second exemplary embodiment, therefore, if it is determined that the fogging of the reversed toner is still caused even after correcting the Vback potential seven times (corresponding to 130 V in terms of the Vback potential), this is determined as indicating the abnormal state of the image forming unit. Then, a message representing the apparatus abnormality is displayed.

Thus, the occurrence of the fogging of the reversed toner is determined by detecting the current amount in the charging auxiliary unit during the period of non-image formation. If it is determined that the fogging of the reversed toner is caused, the fogging of the reversed toner can be suppressed by correcting the Vback potential. Hence, the image forming apparatus can be provided which stably operates without causing a tint variation, undesired streaks in the image due to a charging failure, etc.

While in the second exemplary embodiment the Vback potential is corrected by changing the developing bias voltage Vdc, the Vback potential can also be corrected by changing the surface potential (Vd) of the photosensitive drum. More specifically, if F(H−L) successively exceeds 0.5 μA five times, this is determined as indicating that the fogging of the reversed toner is caused. Then, the voltage applied to the charging roller is increased by 10 V.

Correspondingly, the surface potential Vd of the photosensitive drum is changed from −500 V to −490 V and the Vback potential is reduced from 200 V to 190 V. As a result, the fogging of the reversed toner can be suppressed similarly to the case of correcting Vdc.

Third Exemplary Embodiment

A third exemplary embodiment of the present invention will be described next. The basic construction and operation of the image forming apparatus according to the third exemplary embodiment are the same as those in the first and second exemplary embodiments. Therefore, components having the same or equivalent functions and constructions are denoted by the same symbols and a detailed description of those components is not repeated here. The following description is made of only points specific to the third exemplary embodiment.

In the first and second exemplary embodiments, the Vback potential during the period of non-image formation, i.e., during each of the Preceding Rotation Step, the Inter-Sheet Step, and the Succeeding Rotation Step, is set to the same as the Vback potential during the period of ordinary image formation. Therefore, even when the occurrence of the fogging of the reversed toner is detected and the various correction operations to suppress the fogging of the reversed toner are performed in accordance with the first and second exemplary embodiments, the following problem still arises. Namely, for an image formed immediately before the detection of the fogging, deterioration of image quality is unavoidable because the fogging has already occurred.

In view of such a problem, the third exemplary embodiments is configured to set the Vback potential to a higher level during the period of non-image formation in which the current amount of the charging auxiliary unit is detected, such that the fogging of the reversed toner is more apt to occur during the period of non-image formation. By setting such a state and detecting during the period of non-image formation whether the fogging of the reversed toner is caused, it is possible to prevent the occurrence of the fogging of the reversed toner during the period of ordinary image formation. Details of that process will be described below.

Figure 14:
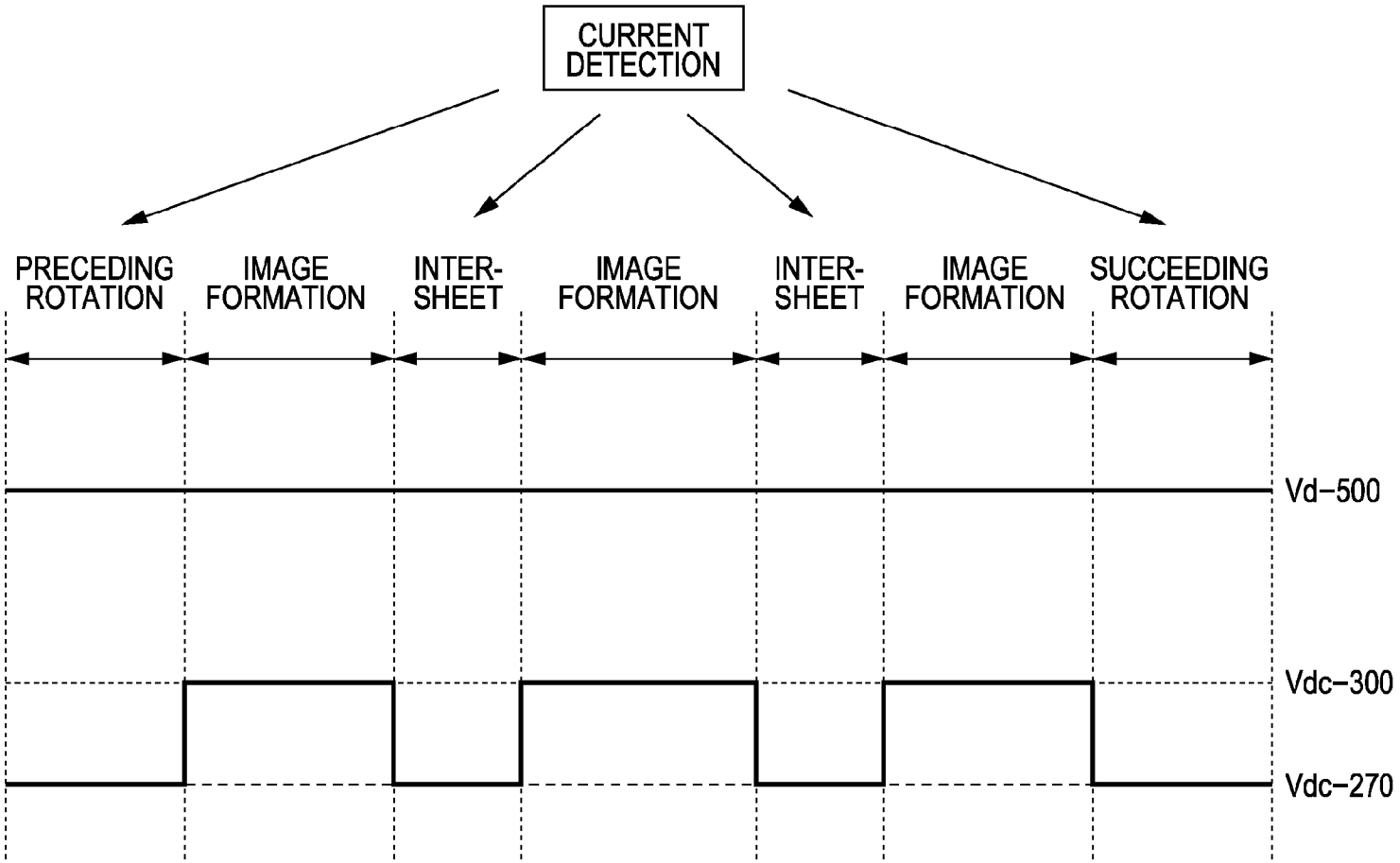
FIG. 14 is a schedule chart illustrating a photosensitive drum potential Vd and a development potential Vdc during a period of ordinary image formation and during a period of not forming an image in the third exemplary embodiment of the present invention.

In the third exemplary embodiment, as shown in FIG. 14, the Vback potential during the period of ordinary image formation is set to 200 V, while the Vback potential during the period of non-image formation, i.e., during each of the Preceding Rotation Step, the Inter-Sheet Step, and the Succeeding Rotation Step, is set to 230 V by changing the developing bias voltage Vdc. Such setting provides a state where the fogging of the reversed toner is more apt to occur during the period of non-image formation than during the period of ordinary image formation. In that state, as with the flowchart of FIG. 12 for the first exemplary embodiment, the current amount (value) in the charge amount control unit 6*b* is successively measured within a predetermined time (0.4 sec in the third exemplary embodiment) during the period of non-image formation. Next, a difference F(H−L) between a maximum value F(H) and a minimum value F(L) of the measured current amount is calculated. If F(H−L) is less than 0.5 μA, this is determined as indicating that the fogging of the reversed toner is not caused. Then, the image forming operation is continued as it is. On the other hand, if F(H−L) successively exceeds 0.5 μA five times, this is determined as indicating that the fogging of the reversed toner is caused. Then, the value of the reference signal Vref in the patch detection mode is reduced by 20 levels (corresponding to 0.5% in terms of the toner density) (i.e., Vref−20).

Thus, by setting the condition that the fogging of the reversed toner is more apt to occur during the period of non-image formation than during the period of ordinary image formation, and detecting whether the fogging of the reversed toner is caused, the occurrence of the fogging of the reversed toner can be prevented during the period of ordinary image formation.

In the third exemplary embodiment, if it is determined that the fogging of the reversed toner is caused, the value of the reference signal Vref in the patch detection mode is corrected. However, as in the second exemplary embodiment, if it is determined that the fogging of the reversed toner is caused, the Vback potential can also be of course corrected to suppress the fogging of the reversed toner.

Fourth Exemplary Embodiment

A fourth exemplary embodiment of the present invention will be described next. The basic construction and operation of the image forming apparatus according to the fourth exemplary embodiment are the same as those in the first to third exemplary embodiments. Therefore, components having the same or equivalent functions and constructions are denoted by the same symbols and a detailed description of those components is not repeated here. The following description is made of only points specific to the fourth exemplary embodiment.

The first to third exemplary embodiments have been described in connection with the image forming apparatus using the cleaner-less system. The fourth exemplary embodiment is intended to show that the present invention can also be applied to an image forming apparatus including a cleaning member.

Figure 15:
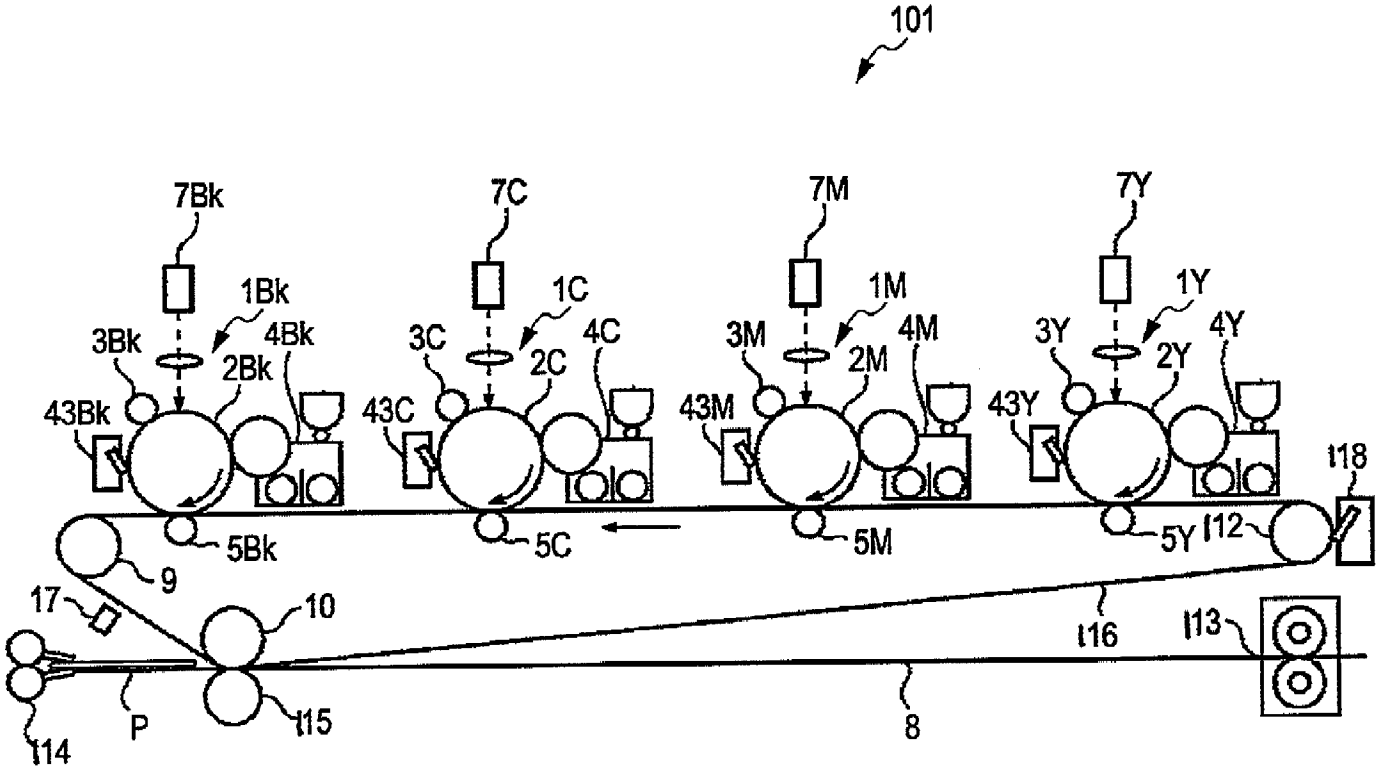
FIG. 15 is a schematic view illustrating one example of an image forming apparatus to which is applied a fourth exemplary embodiment of the present invention.

The overall construction and operation of the image forming apparatus according to the fourth exemplary embodiment are first described. FIG. 15 is a schematic view of an image forming apparatus 101 according to the fourth exemplary embodiment. The image forming apparatus 101 is an electrophotographic full-color printer including four image forming sections 1Y, 1M, 1C, 1Bk which are provided corresponding to four colors, i.e., yellow, magenta, cyan, and black.

Around a photosensitive drum 2, there are arranged a charging roller 3 as a charging unit, a developing apparatus 4 as a developing unit, a primary transfer roller 5 and a secondary transfer roller 115 each serving as a transfer unit, a secondary transfer opposite roller 10, and a cleaning apparatus 43 as a cleaning unit. A laser scanner (exposure apparatus) 7 as an exposure unit is arranged above the photosensitive drum 2, as viewed on the drawing. Further, an intermediate transfer belt 116 is disposed so as to run in an opposed relation to the photosensitive drum 2 of each image forming section 1. The intermediate transfer belt 116 is driven by a driving roller 9 to circulate in the direction of an arrow indicated in the drawing such that the toner image is conveyed to a contact region where the toner image is contacted with the recording material P. After the toner image is transferred from the intermediate transfer belt 116 to the recording material P, the toner image is fused and fixed to the recording material P by a fusing apparatus 113.

The following description is made of, by way of example, the operating of forming a four-full-color image. When the image forming operation is started, the surface of the rotating photosensitive drum 2 is first uniformly charged by the charging roller 3. At that time, a charging bias is applied to the charging roller 3 from a charging-bias power supply. Then, the photosensitive drum 2 is exposed by a laser beam that is emitted from the exposure apparatus 7 in accordance with an image signal. An electrostatic image (latent image) corresponding to the image signal is thereby formed on the photosensitive drum 2. The electrostatic image on the photosensitive drum 2 is visualized to a visible image by a toner contained in the developing apparatus 4.

A toner image is formed on the photosensitive drum 2 by the developing apparatus 4, and the formed toner image is primarily transferred to the intermediate transfer belt 116. The toner remaining on the surface of the photosensitive drum 2 after the primary transfer (i.e., the after-transfer remaining toner) is removed by the cleaning apparatus 43.

The above-described operation is successively repeated for each of yellow, magenta, cyan, and black such that the toner images of four colors are superimposed with one another on the intermediate transfer belt 116. Then, in match with the timing of forming the four-color toner image, the recording material P contained in a recording material cassette (not shown) is conveyed by a feed roller 114 and a conveying member 8. By applying a secondary transfer bias to the secondary transfer roller 115, the four-color toner image on the intermediate transfer belt 116 is secondarily transferred at a time onto the recording material P which is supported on the conveying member 8.

Then, the recording material P is separated from the conveying member 8 and is conveyed to the fusing apparatus 113 which serves as the fusing unit. The recording material P is heated and pressed in the fusing apparatus 113 so that the toners on the recording material P are fused and mixed with one another to produce a full-color permanent image. Thereafter, the recording material P is ejected out of the image forming apparatus.

The toner remaining on the intermediate transfer belt 116 without being transferred in a secondary transfer section is removed by an intermediate transfer belt cleaner 118. A series of image forming operations is thus completed.

Figure 16:
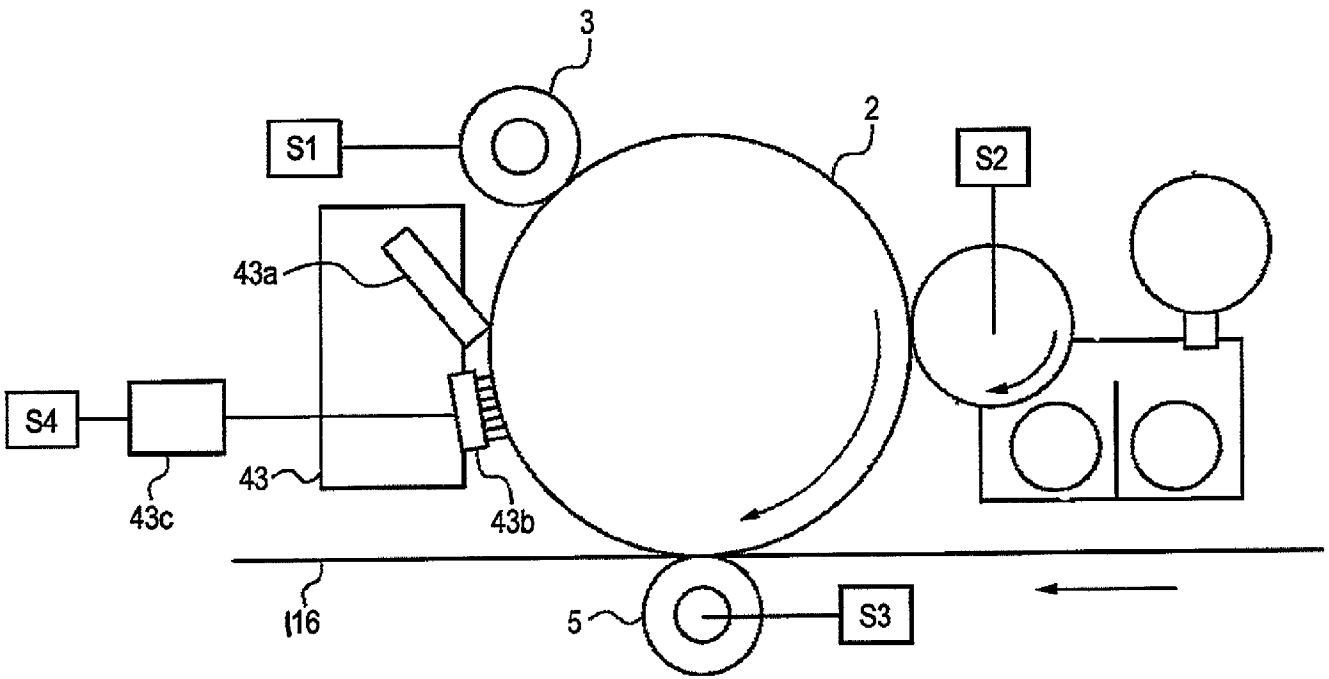
FIG. 16 is an explanatory view illustrating an image forming unit in the fourth exemplary embodiment of the present invention.

The operation of the image forming section 1 will be described next in detail with reference to FIG. 16.

In the fourth exemplary embodiment, the cleaning apparatus 43 includes a cleaning blade 43*a* and a charging auxiliary member 43*b*. A DC voltage of −150 V is applied to the charging auxiliary member 43*b*. The charging auxiliary member 43*b* cancels charges of the after-transfer remaining toner on the photosensitive drum to reduce an electrostatic attachment force of the toner onto the photosensitive drum. As a result, the after-transfer remaining toner can be more easily cleaned and a cleaning failure can be avoided. Further, the image forming apparatus according to the fourth exemplary embodiment includes a current detecting unit 43*c* configured to detect a current amount in the charging auxiliary member 43*b*. The timing of detecting the current amount is set such that the detection is performed once for each of the Preceding Rotation Step, the Inter-Sheet Step, and the Succeeding Rotation Step which correspond to the period of non-image formation.

The current amount in the charging auxiliary member 43*b* is detected within a predetermined time during the period of non-image formation. If the difference between a maximum value and a minimum value of the current amount successively exceeds a reference value over a plural number of times (5 in the fourth exemplary embodiment), this is determined as indicating that the fogging of the reversed toner is caused in the image forming unit. Then, the value of the above-described reference signal Vref in the patch detection mode is corrected so as to reduce the toner density.

A process of detecting the current amount and correcting the patch reference signal Vref in the Inter-Sheet Step, which represents one example of the non-image formation period, will be described in detail with reference to the flowchart of FIG. 12.

First, the current amount in the charging auxiliary member 43*b* is successively measured within a predetermined time (0.4 sec in the fourth exemplary embodiment) during the Inter-Sheet Step. Next, as shown in FIG. 12, a difference F(H−L) between a maximum value F(H) and a minimum value F(L) of the measured current amount is calculated. If F(H−L) is less than 0.5 μA, this is determined as indicating that the fogging of the reversed toner is not caused. Then, the image forming operation is continued as it is. On the other hand, if F(H−L) successively exceeds 0.5 μA five times, this is determined as indicating that the fogging of the reversed toner is caused. Then, the value of the reference signal Vref in the patch detection mode is reduced by 20 levels (corresponding to 0.5% in terms of the toner density) (i.e., Vref−20).

Thus, the occurrence of the fogging of the reversed toner is determined by detecting the current amount in the charging auxiliary member 43*b* during the period of non-image formation. If it is determined that the fogging of the reversed toner is caused, the toner density is made appropriate by correcting the value of the reference signal in the patch detection mode. As a result, the charge amount of the carrier can be increased and the fogging of the reversed toner can be prevented. The image forming apparatus can be hence provided which stably operates without causing a tint variation.

In the fourth exemplary embodiment, if it is determined that the fogging of the reversed toner is caused, the value of the patch reference signal Vref is corrected. However, as in the second exemplary embodiment, if it is determined that the fogging of the reversed toner is caused, the Vback potential can be of course corrected instead.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2006-329622 filed Dec. 6, 2006, which is hereby incorporated by reference herein in its entirety.

What is claimed is:

1. An image forming apparatus comprising:

an image bearing member on which an electrostatic image is capable of being formed;

a charging apparatus configured to charge the image bearing member in a charging section;

a developing apparatus containing developer which includes toner and carrier, the developing apparatus being configured to develop, in a developing section, an electrostatic image formed on the image bearing member;

a transfer apparatus configured to transfer a toner image formed on the image bearing member to a transfer medium in a transfer section;

a charging auxiliary apparatus including a charging auxiliary member contacting with the image bearing member at a position downstream of the transfer section and upstream of the charging section in a moving direction of the image bearing member, and a voltage applying device configured to apply a voltage to the charging auxiliary member, the charging auxiliary apparatus being able to change a charge amount of the toner on the image bearing member;

a current detecting device configured to detect a current flowing in the charging auxiliary member during a period of non-image formation when the voltage is applied to the charging auxiliary member;

a toner density detecting device configured to detect information regarding a toner density of the developer in the developing apparatus; and a toner supply control device configured to control supply of the toner to the developing apparatus based on a detection result of the current detecting device and a detection result of the toner density detecting device.

2. The image forming apparatus according to claim 1, wherein the toner supply control device controls the supply of the toner to the developing apparatus based on a differential value between a maximum value and a minimum value of the toner density, which is obtained within a reference time by a detecting operation of the toner density detecting device.

3. The image forming apparatus according to claim 2, wherein the toner supply control device controls the supply of the toner to make the toner density of the developer closer to a target value, and changes the target value in a direction to reduce the toner density when the differential value is larger than a reference value.

4. The image forming apparatus according to claim 1, wherein the toner density detecting device includes a sensor configured to detect a reflection density of a detection-adapted toner image obtained by developing a detection-adapted electrostatic image, which is formed on the image bearing member, by the developing apparatus.

5. The image forming apparatus according to claim 1, wherein the toner density detecting device includes an optical sensor or a permeability sensor configured to detect the toner density of the developer in the developing apparatus.

6. The image forming apparatus according to claim 1, wherein the current detecting device is configured to compare the differential value between the maximum value and the minimum value of the current, which is obtained within the reference time by the detecting operation, with a reference value, and the image forming apparatus further comprises:

a display device configured to display an abnormality of the image forming apparatus when results of the comparison performed by the current detecting device plural times indicate that a state where the differential value is larger than the reference value in the comparison occurs successively over a reference number of times.

7. The image forming apparatus according to claim 1, wherein the developing apparatus is configured to be able to recover, in a developing operation, the toner remaining on the image bearing member after a transfer operation by the transfer apparatus.

* * * * *